US007348940B2

(12) United States Patent
Cho et al.

(10) Patent No.: US 7,348,940 B2
(45) Date of Patent: Mar. 25, 2008

(54) DRIVING CIRCUIT FOR ENERGY RECOVERY IN PLASMA DISPLAY PANEL

(75) Inventors: Bo-Hyung Cho, Seoul (KR); Dong-Young Lee, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 88 days.

(21) Appl. No.: 10/501,201

(22) PCT Filed: Jan. 10, 2003

(86) PCT No.: PCT/KR03/00040

§ 371 (c)(1),
(2), (4) Date: Jul. 28, 2005

(87) PCT Pub. No.: WO03/058592

PCT Pub. Date: Jul. 17, 2003

(65) Prior Publication Data

US 2006/0043908 A1 Mar. 2, 2006

(30) Foreign Application Priority Data

Jan. 11, 2002 (KR) ..... 10-2002-0001593

(51) Int. Cl.
*G09G 3/28* (2006.01)

(52) U.S. Cl. ..... 345/66; 345/62; 345/60; 345/76

(58) Field of Classification Search ..... 345/66, 345/68, 67, 69, 70, 63, 62, 60, 76, 77, 211, 345/212, 214, 204; 315/169.3, 169.4
See application file for complete search history.

(56) References Cited

U.S. PATENT DOCUMENTS

| | | | | |
|---|---|---|---|---|
| 5,126,727 | A | 6/1992 | Asars | |
| 5,642,018 | A | 6/1997 | Marcotte | |
| 6,617,802 | B2 * | 9/2003 | Roh | 315/169.4 |
| 2002/0097203 | A1 * | 7/2002 | Onozawa et al. | 345/67 |

FOREIGN PATENT DOCUMENTS

| | | |
|---|---|---|
| JP | 1998-301530 | 11/1998 |
| JP | 2000-206919 | 7/2000 |

* cited by examiner

*Primary Examiner*—Tuyet Vo
(74) *Attorney, Agent, or Firm*—Christie, Parker & Hale, LLP

(57) ABSTRACT

An energy recovery driving circuit of the present invention has a resonant inductor, a primary coil and at least one secondary coil of a transformer, and an energy recovery unit. The resonant inductor is connected to the load for allowing a charge and/or discharge current to be applied to the load to flow through the resonant inductor. The primary coil is connected to the resonant inductor, and is connected to both the resonant inductor and the load so as to allow the charge and/or discharge current to flow through the primary coil when the charging and/or discharge current flows through the load. The secondary coil is coupled to the primary coil. The energy recovery unit generates a current according to the predetermined number of turns of the secondary coil to allow the current flowing through the secondary coil to be recovered to a supply voltage source.

29 Claims, 37 Drawing Sheets

PRIOR ART

PRIOR ART

PRIOR ART

PRIOR ART

DRIVING CIRCUIT FOR ENERGY RECOVERY IN PLASMA DISPLAY PANEL

TECHNICAL FIELD

The present invention relates, in general, to a driving circuit for energy recovery in a plasma display panel and, more particularly, to a driving circuit for energy recovery, which employs a new construction that uses a regenerative transformer, thus simplifying the energy recovery driving circuit used during a sustain period of the plasma display panel, increasing energy recovery efficiency, and enabling a zero voltage switching to be performed.

BACKGROUND ART

In the case of a surface discharge type alternating current (AC) plasma display panel (PDP), a high voltage is periodically applied to a panel capacitance. Generally, a driving circuit for energy recovery is employed in a driving circuit for such a PDP. The energy recovery driving circuit is a circuit that increases system efficiency, reduces Electromagnetic Interference (EMI) noise and stably/effectively drives a PDP for a sustain period by recovering energy of a charged/discharged panel capacitance.

FIGS. 1 to 4 illustrate various conventional energy recovery driving circuits. In this case, third to sixth switches SW3 to SW6 are preferably switches (also called clamping switches) provided with backward body diodes and capable of high speed switching. In the conventional energy recovery driving circuits shown in FIGS. 1 to 3, first and third switches SW1 and SW3 are also preferably switches provided with backward body diodes. Further, a resonant inductor L is an unsaturated inductor, which is operated linearly within the range of a panel drive operating current.

In the drawings, a PDP is represented by an equivalent circuit modeled upon a parallel circuit that consists of a current source indicating discharge current and a capacitance C with a certain value. First, second, fifth and sixth diodes D1, D2, D5 and D6 represent high speed switching diodes.

In a first conventional circuit shown in FIG. 1, a first switch SW1 is turned on to allow an input voltage to be converted to a resonance voltage, thus charging the panel capacitance C through the resonant inductor L. In this case, the voltage of the panel capacitance C increases up to the input voltage by the resonance of the resonant inductor L connected in series with the panel capacitance C (because a voltage at the resonant inductor L, v=L (di/dt)), and, immediately after that, the third switch SW 3 is turned on to supply energy to the panel. When the panel capacitance C is discharged, the second switch SW2 is turned on to cause resonance, thus recovering voltage energy stored in the panel capacitance C to an input voltage source. In this case, the first conventional circuit is. disadvantageous in that, since the first switch SW1 must be compulsorily turned off when the voltage of the panel capacitance C becomes ½ of the input voltage (which is a voltage input to the panel during a sustain period, that is, sustain voltage), a control operation is complicated, and since a turn-off hard switching must be carried out when a maximum current flows through the switch, operating efficiency is deteriorated. Further, even at the time of energy recovery, since the second switch SW2 must be compulsorily turned off when a voltage between both ends of the panel capacitance C becomes ½ of the input voltage, a control operation is also complicated and operating efficiency is deteriorated. Further, when the panel is discharged, the turn-on control of the third switch SW3 must be accurately performed to smoothly supply energy to the panel.

In a second conventional circuit shown in FIG. 2, a very large capacitor voltage source or capacitor DC with a voltage of ½ of a panel input voltage is provided outside the circuit, and the resonance of a resonant inductor L connected in series with the panel capacitance C is used. A first switch SW1 is turned on to increase a voltage of the panel capacitance to the input voltage, and, immediately after that, the second switch SW3 is turned on to supply energy to the panel. Thereafter, the second switch SW2 is turned on to cause resonance, thus recovering voltage energy stored in the panel capacitance C to the capacitor voltage source DC. Since half-wave resonance is naturally finished by diodes D1 and D2 connected in series with the first and second switches SW1 and SW2, respectively, a zero voltage switching can be performed and a control operation is simplified, but the number of elements increases and the circuit is complicated. Further, since the voltage of the capacitor voltage source DC is actually maintained at a level less than ½ of the input voltage due to the loss of the circuit, a voltage between both ends of the panel capacitance C cannot increase up to the input voltage. That is, the energy recovery driving circuit is operated while the resonance energy of thereof is always insufficient due to system loss. In order to overcome this disadvantage, there is required a control operation of maintaining the voltage of the capacitor voltage source DC at a level greater than or equal to a certain value (less than or equal to a certain voltage when the panel capacitance C is discharged). Further, since high frequency pulse current flows through the capacitor voltage source DC, Equivalent Series Resistance (ESR) loss is also generated. A circuit identical with each of the first and second conventional circuits is symmetrically arranged on the opposite side of the panel, and acts as an inverter circuit during one period, thus performing repeated operations.

A third conventional circuit shown in FIG. 3 performs resonance using a resonant inductor L connected in parallel with a panel capacitance C. First and fourth switches SW1 and SW4 are turned on to supply energy to a panel, and are simultaneously turned off after the supply of energy is finished. At this time, if a fifth switch SW5 is turned on, a voltage between both ends of the panel capacitance C half-wave resonates from a positive input voltage to a negative input voltage, and the resonance is spontaneously stopped by a fifth diode D5.

At this time, the third and second switches SW3 and SW2 are turned on to supply energy to the panel from the opposite direction. In the same manner as the above process, a second switch SW6 is turned on to perform a next operation. The third conventional circuit is disadvantageous in that the voltage between both ends of the panel capacitance suddenly changes from a positive input voltage to a negative input voltage, and it cannot increase up to the input voltage due to system loss as in the case of the second conventional circuit.

In a fourth conventional circuit of FIG. 4, modified from the third conventional circuit, a panel is divided into PDP1 and PDP 2 and panel capacitances are allowed to resonate with resonant inductors L1 and L2 connected in series with the panel capacitances, respectively. Since different inductors are used at the rising and falling of the voltage, rising and falling timing can be controlled and the voltage does not change suddenly. However, the fourth conventional circuit is disadvantageous in that the circuit and the control operation thereof are excessively complicated, and the voltage between both ends of each panel capacitance cannot increase up to the input voltage due to system loss.

The first conventional circuit is disadvantageous in that loss is generated due to the hard-switching, and accurate turn-off control for switches is required. The second conventional circuit is disadvantageous in that a large capacitor operated as another voltage source must be provided outside the circuit, and the number of elements increases. Further, the first to fourth conventional circuits require the accurate turn-on control for the third switch SW3 so as to smoothly supply energy to the panel. Further, the third conventional circuit is disadvantageous in that it is difficult to control the sudden change of the voltage between both ends of the panel capacitance, and it is also difficult to smoothly supply energy to the panel through the first to fourth switches SW1 to SW4. The fourth conventional circuit is disadvantageous in that the circuit and the control operation thereof are excessively complicated, and the panel must be divided into two parts and driven. The second to fourth conventional circuits are disadvantageous in that the voltage between both ends of the panel capacitance cannot increase up to the input voltage due to system loss. Accordingly, the second to fourth conventional circuits are problematic in that they cannot guarantee 100% zero voltage switching of the inverter clamping switches SW3 and SW4 supplying discharging energy to the panel, and switching loss and EMI noise are generated.

DISCLOSURE OF THE INVENTION

Accordingly, the present invention has been made keeping in mind the above problems occurring in the prior art, and an object of the present invention is to provide an energy recovery driving circuit, which directly recovers charging/discharging energy of a panel capacitance to a voltage source using a regenerative transformer, thus remarkably decreasing the number of necessary elements relative to conventional circuits, and simplifying a control operation.

Another object of the present invention is to provide an energy recovery driving circuit, in which resonance conditions can be set such that a voltage between both ends of a panel capacitance increases up to an input voltage in spite of system loss.

A further object of the present invention is to provide an energy recovery driving circuit, which can effectively and stably drive the discharging of a PDP.

In accordance with one aspect of the present invention, the above and other objects can be accomplished by the provision of an energy recovery driving circuit for driving a load with a certain capacitance, comprising a resonant inductor coupled to the load for alternately allowing a charge current or a discharge current to be applied to the load to flow through the resonant inductor; a primary coil of a transformer, coupled to the resonant inductor, the primary coil being coupled to both the resonant inductor and the load so as to alternately allow the charge current or the discharge current to flow through the primary coil when the charge current or the discharge current alternately flows through the load through the resonant inductor; at least one secondary coil of the transformer, coupled to the primary coil; and an energy recovery unit for generating a current according to the predetermined number of turns of the secondary coil in the secondary coil to allow the current flowing through the secondary coil to be recovered to a supply voltage source.

Preferably, the energy recovery unit comprises first switching means coupled to a supply voltage for receiving a first switching signal to allow a resonance current used to charge the load to flow through the resonant inductor from the supply voltage; and second switching means coupled to ground for receiving a second switching signal to allow a resonance current used to discharge the load to flow through the resonant inductor from the load.

Preferably, the energy recovery driving circuit further comprises a sustain driving unit for supplying a sustain voltage to the load; wherein the sustain driving unit comprises third switching means coupled between the supply voltage and the load to supply the sustain voltage to the load by reception of a third switching signal after the load is charged by the resonance current used to charge the load, fourth switching means coupled between the ground and the load to apply a ground voltage to the load by reception of a fourth switching signal after the load is discharged by the resonance current used to discharge the load, a first body diode coupled in parallel with the third switching means to prevent a charged voltage of the load from increasing to be greater than the supply voltage when the load is charged, and a second body diode coupled in parallel with the fourth switching means to prevent a discharged voltage of the load from decreasing to be less than the ground voltage when the load is discharged.

In this case, the resonance current is recovered to a supply voltage source through the third body diode after the load is charged to be greater than or equal to the supply voltage, and the resonance current is recovered to the ground through the fourth body diode after the load is discharged to be less than or equal to the ground voltage.

BEST MODE FOR CARRYING OUT THE INVENTION

Figure 1:
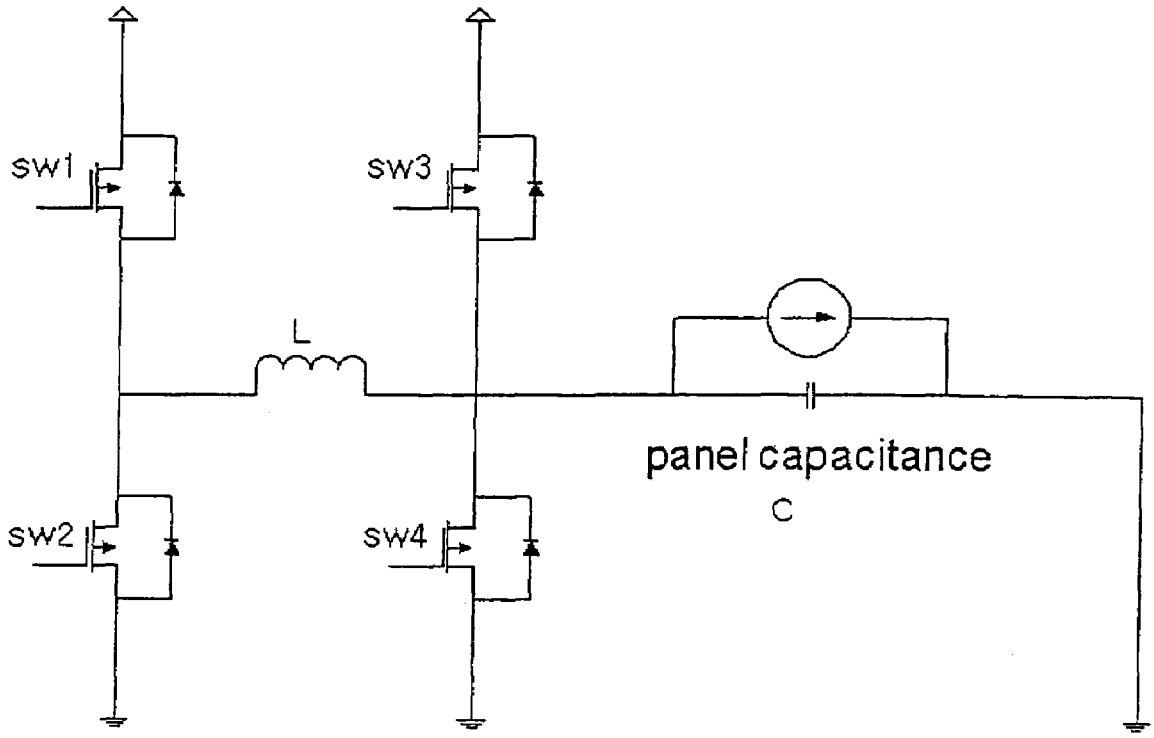
FIG. 1 is a circuit diagram of a conventional energy recovery driving circuit.
Figure 2:
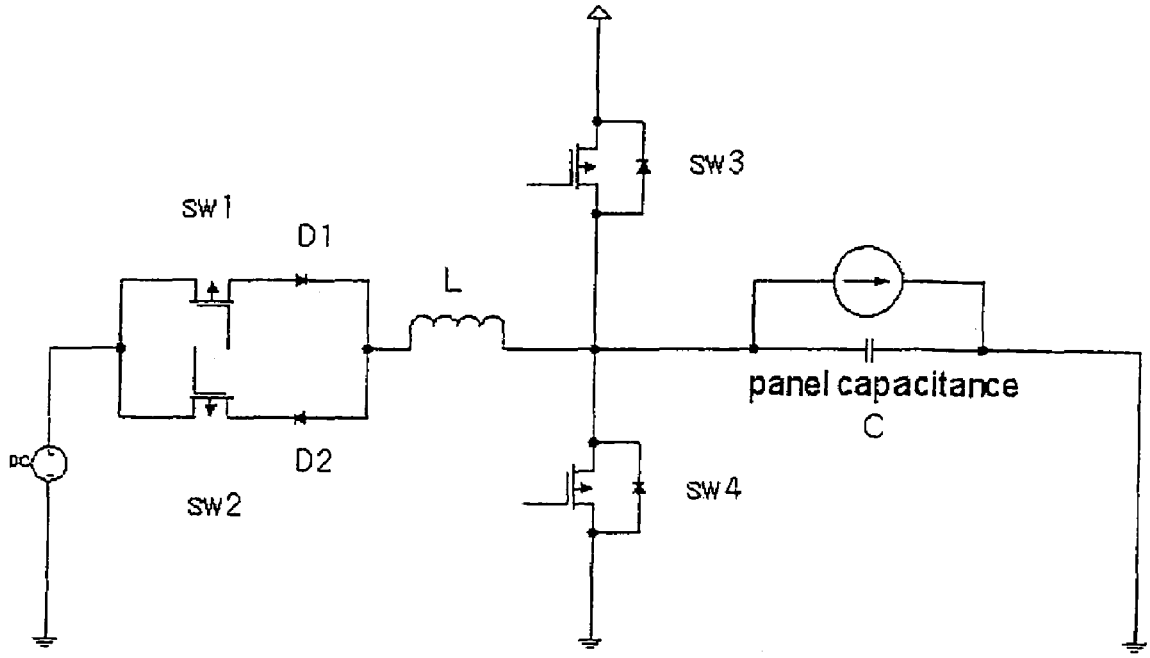
FIG. 2 is a circuit diagram of another conventional energy recovery driving circuit.
Figure 3:
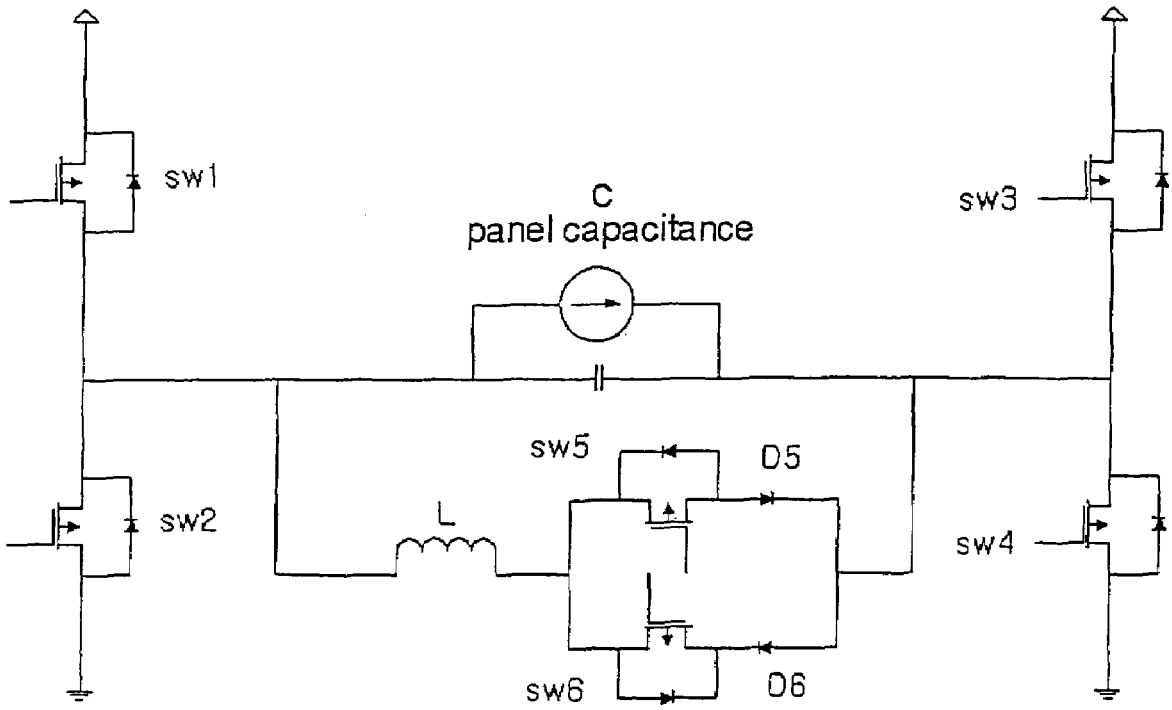
FIG. 3 is a circuit diagram of a further conventional energy recovery driving circuit.
Figure 4:
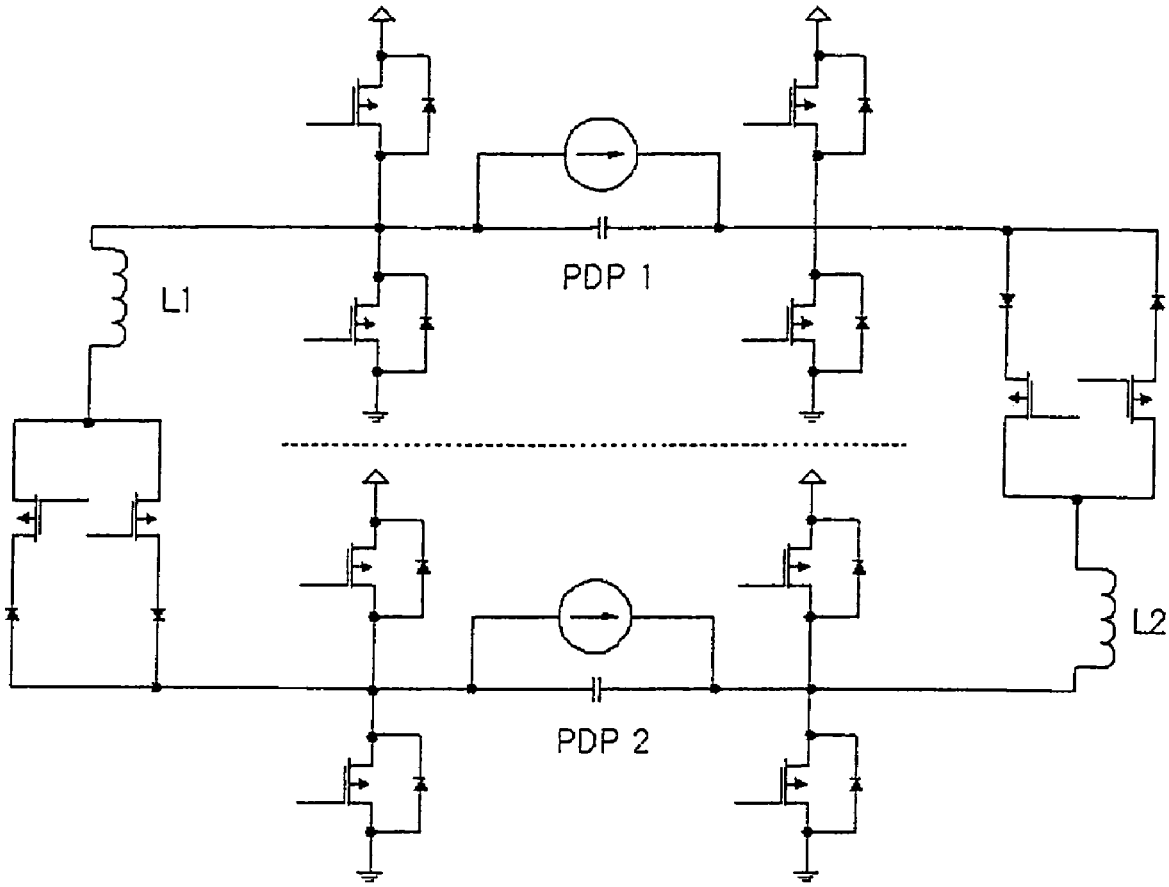
FIG. 4 is a circuit diagram of still another conventional energy recovery driving circuit.
Figure 5:
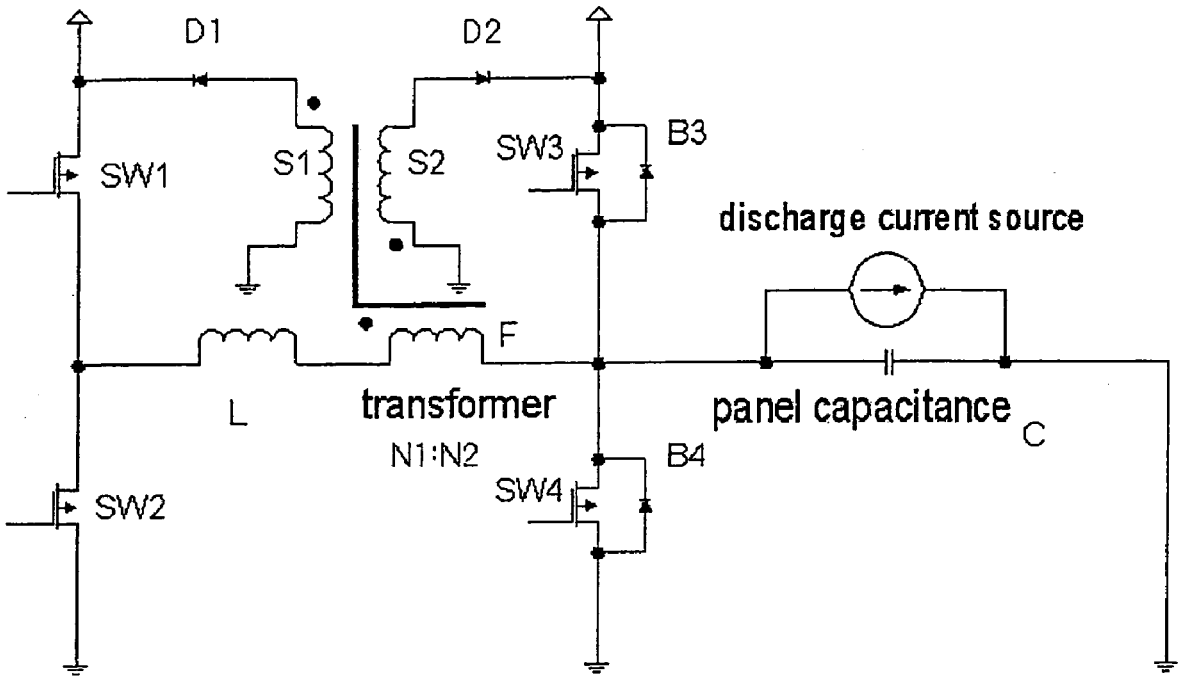
FIG. 5 is a circuit diagram of a first energy recovery driving circuit according to a first embodiment of the present invention.

In the energy recovery driving circuit according to a first embodiment of the present invention illustrated in FIG. 5, for example, the primary coil is connected between the resonant inductor and the load, the first switching means is connected between the supply voltage and the resonant inductor, and the second switching means is connected between the resonant inductor and the ground; and the energy recovery unit further comprises first and second diodes D1 and D2 for conducting a current in a direction of the supply voltage source. The secondary coil comprises a first secondary coil connected in series with the first diode between the supply voltage and the ground and coupled to the primary coil so as to allow a charge current to flow through the supply voltage source when the charge current flows through the primary coil, and a second secondary coil connected in series with the second diode between the supply voltage and the ground and coupled to the primary coil so as to allow a discharge current to flow into the supply voltage source when the discharge current flows through the primary coil.

Figure 6:
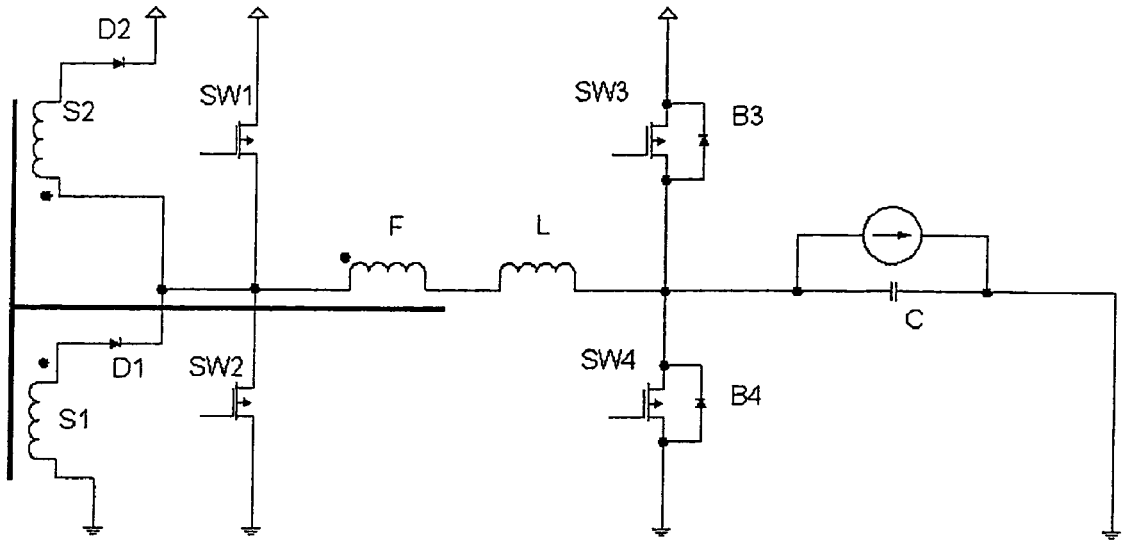
FIG. 6 is a circuit diagram of a second energy recovery driving circuit according to a second embodiment of the present invention.

In the energy recovery driving circuit according to a second embodiment of the present invention illustrated in FIG. 6, for example, the primary coil has a first end connected to the resonant inductor and a second end connected to both the first and second switching means, the first switching means is connected between the supply voltage and the primary coil, and the second switching means is connected between the primary coil and the ground; the energy recovery unit further comprises a first diode D1 for conducting a current in an opposite direction of the ground voltage from the ground voltage and a second diode D2 for conducting a current in a direction of the supply voltage; and the secondary coil comprises a first secondary coil connected in series with the first diode between the primary coil and the ground, and coupled to the primary coil so as to allow a charge current to flow out from the ground when the charge current flows through the primary coil, and a second secondary coil connected in series with the second diode between the supply voltage and the primary coil, and the ground voltage and coupled to the primary coil so as to allow a discharge current to flow into the supply voltage source when the discharge current flows through the primary coil.

Figure 7:
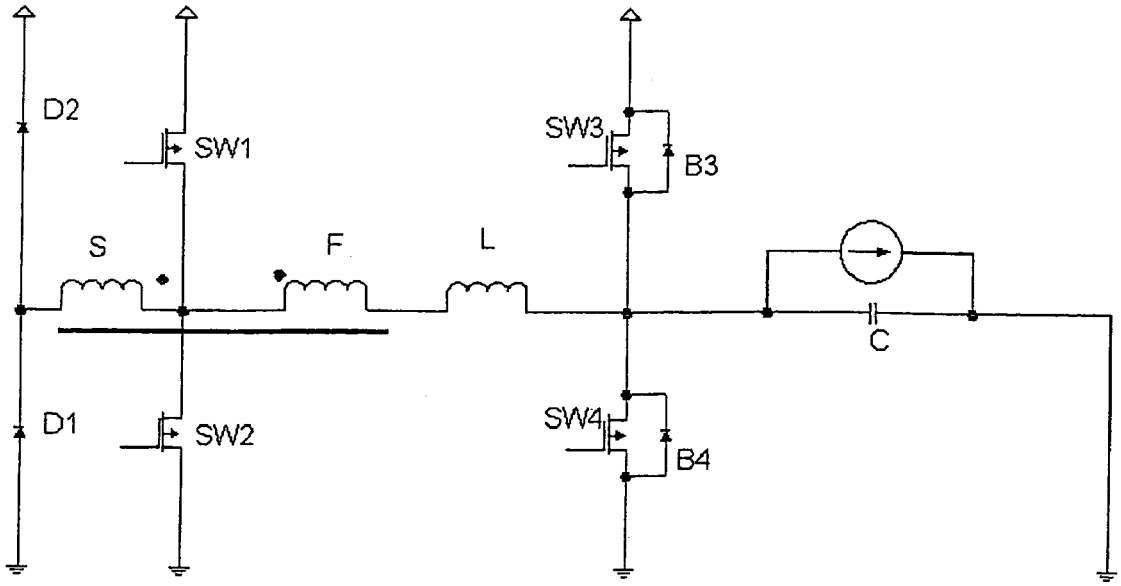
FIG. 7 is a circuit diagram of a third energy recovery driving circuit according to a third embodiment of the present invention.

In the energy recovery driving circuit according to a third embodiment of the present invention illustrated in FIG. 7, for example, the primary coil has a first end connected to the resonant inductor and a second end connected to both the first and second switching means, the first switching means is connected between the supply voltage and the primary coil, and the second switching means is connected between the primary coil and the ground; the energy recovery unit further comprises a first diode D1 for conducting a current in an opposite direction of the ground and a second diode D2 for conducting a current in a direction of the supply voltage; and the secondary coil is provided with a first end connected to the primary coil and a second end connected to a common end of the first and second diodes, and is coupled to the primary coil for allowing a charge current to flow out from the ground when the charge current flows through the primary coil and allowing a discharge current to flow into the supply voltage source when the discharge current flows through the primary coil.

Figure 8:
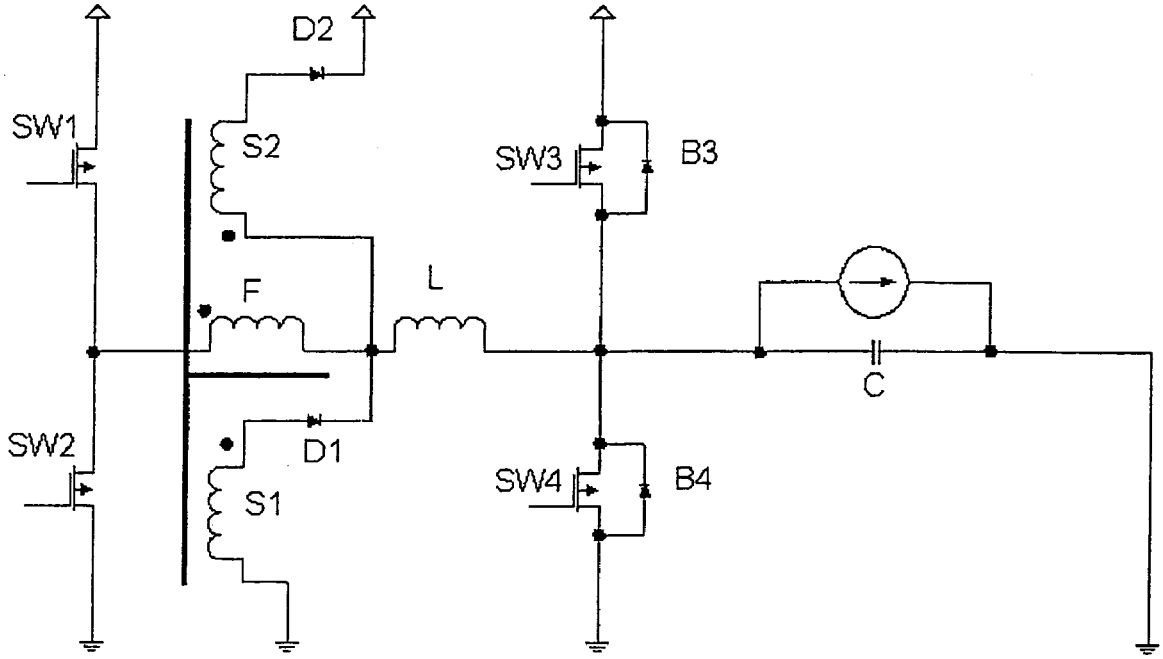
FIG. 8 is a circuit diagram of a fourth energy recovery driving circuit according to a fourth embodiment of the present invention.

In the energy recovery driving circuit according to a fourth embodiment of the present invention illustrated in FIG. 8, for example, the primary coil has a first end connected to the resonant inductor and a second end connected to both the first and second switching means, the first switching means is connected between the supply voltage and the primary coil, and the second switching means is connected between the primary coil and the ground; the energy recovery unit further comprises a first diode D1 for conducting a current in an opposite direction of the ground and a second diode D2 for conducting a current in a direction of the supply voltage; and the secondary coil comprises a first secondary coil connected in series with the first diode between a common end of the primary coil and the resonant inductor and the ground, and coupled to the primary coil so as to allow a charge current to flow out from the ground when the charge current flows through the primary coil, and a second secondary coil connected in series with the second diode between the supply voltage and the common end of the primary coil and the resonant inductor, and coupled to the primary coil so as to allow a discharge current to flow into the supply voltage source when the discharge current flows through the primary coil.

Figure 9:
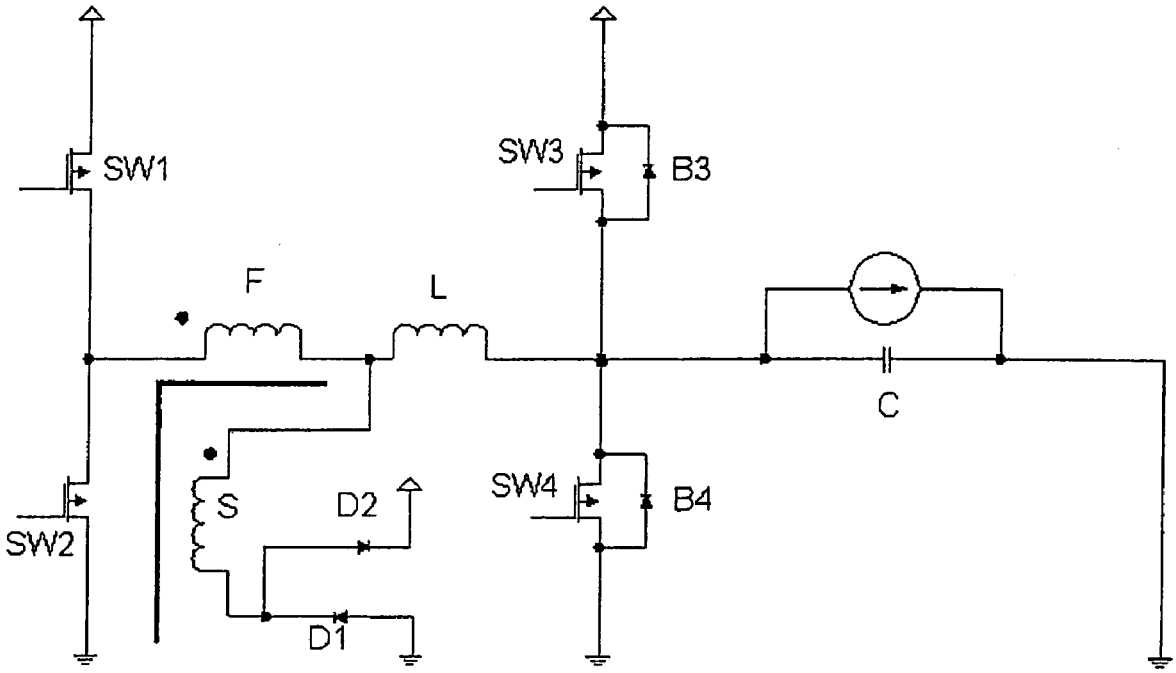
FIG. 9 is a circuit diagram of a fifth energy recovery driving circuit according to a fifth embodiment of the present invention.

In the energy recovery driving circuit according to a fifth embodiment of the present invention illustrated in FIG. 9, for example, the primary coil has a first end connected to the resonant inductor and a second end connected to both the first and second switching means, the first switching means is connected between the supply voltage and the primary coil, and the second switching means is connected between the primary coil and the ground; the energy recovery unit further comprises a first diode D1 for conducting a current in an opposite direction of the ground and a second diode D2 for conducting a current in a direction of the supply voltage; and the secondary coil is connected between a common end of the primary coil and the resonant inductor and a common end of the first and second diodes, and is coupled to the primary coil for allowing a charge current to flow out from the ground when the charge current flows through the primary coil and allowing a discharge current to flow into the supply voltage source when the discharge current flows through the primary coil.

Figure 10:
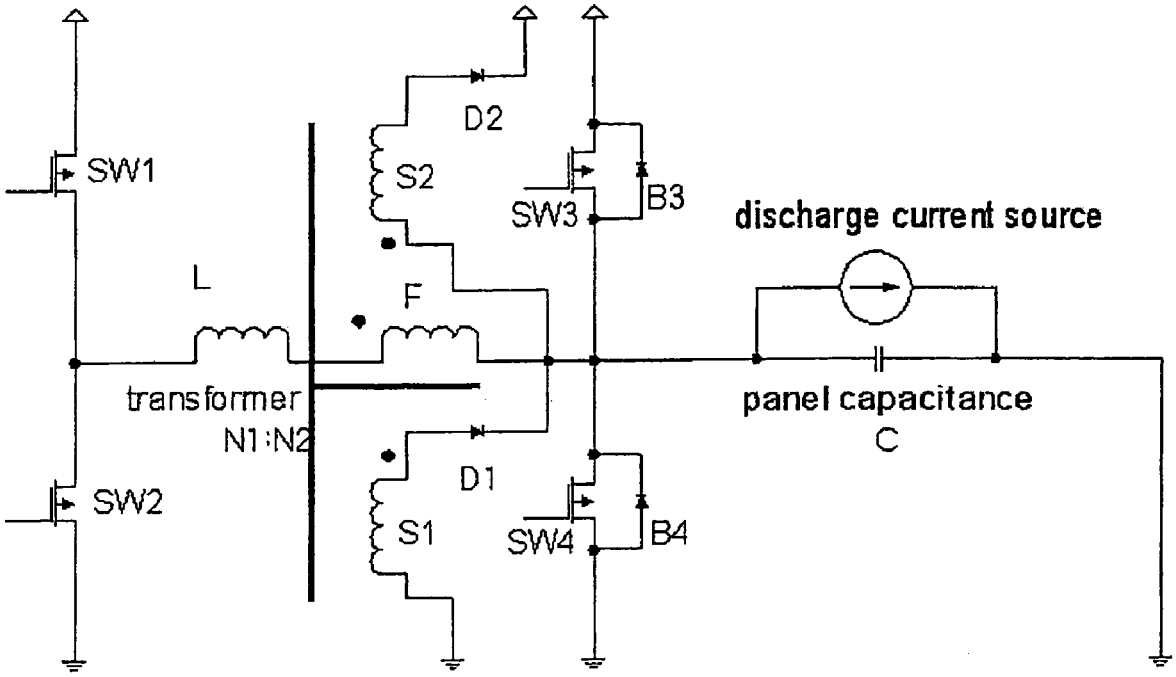
FIG. 10 is a circuit diagram of a sixth energy recovery driving circuit according to a sixth embodiment of the present invention.

In the energy recovery driving circuit according to a sixth embodiment of the present invention illustrated in FIG. 10, for example, the primary coil has a first end connected to the resonant inductor and a second end connected to the load, the first switching means is connected between the supply voltage and the resonant inductor, and the second switching means is connected between the resonant inductor and the ground; the energy recovery unit further comprises a first diode D1 for conducting a current in an opposite direction of the ground and a second diode D2 for conducting a current in a direction of the supply voltage; and the secondary coil comprises a first secondary coil connected in series with the first diode between a common end of the primary coil and the load and the ground, and coupled to the primary coil so as to allow a charge current to flow out from the ground when the charge current flows through the primary coil, and a second secondary coil connected in series with the second diode between the supply voltage and the common end of the primary coil and the load, and coupled to the primary coil so as to allow a discharge current to flow into the supply voltage source when the discharge current flows through the primary coil.

Figure 11:
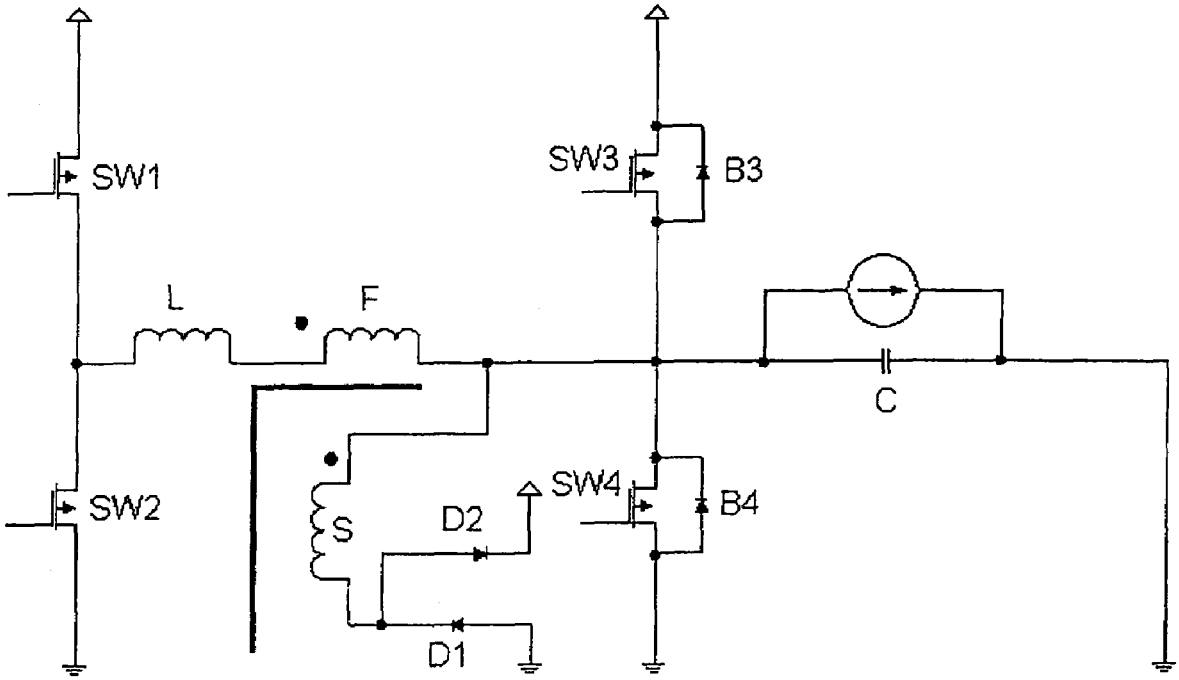
FIG. 11 is a circuit diagram of a seventh energy recovery driving circuit according to a seventh embodiment of the present invention.

In the energy recovery driving circuit according to a seventh embodiment of the present invention illustrated in FIG. 11. for example, the primary coil has a first end connected to the resonant inductor and a second end connected to the load, the first switching means is connected between the supply voltage and the resonant inductor, and the second switching means is connected between the resonant inductor and the ground; the energy recovery unit further comprises a first diode D1 for conducting a current in an opposite direction of the ground and a second diode D2 for conducting a current in a direction of the supply voltage; and the secondary coil is connected between a common end of the primary coil and the load and a common end of the first and second diodes, and is coupled to the primary coil for allowing a charge current to flow out from the ground when the charge current flows through the primary coil and allowing a discharge current to flow into the supply voltage source when the discharge current flows through the primary coil.

Hereinafter, preferred embodiments of the present invention will be described in detail with reference to the attached drawings.

The attached drawings are only embodiments, and the scope of the present invention is not limited to the embodiments. Those skilled in the art will appreciate that elements shown in the drawings can be replaced by means performing functions similar to the elements.

FIG. 5 is a circuit diagram of a first energy recovery driving circuit according to a first embodiment of the present invention. In the embodiments illustrated in FIGS. 5, 6, 7, 8, 9, 10, and 11, an energy recovery unit comprises first switching means (or switch) SW1 connected to a supply voltage for receiving a first switching signal to allow a resonance current used to charge the load to flow through the resonant inductor from the supply voltage; and second switching means (or switch) SW2 connected to ground for receiving a second switching signal to allow a resonance current used to discharge the load to flow through the resonant inductor from the load.

In this case, third and fourth switches SW3 and SW4 are preferably switches having backward body diodes B3 and B4, respectively, and capable of high speed switching. However, first and second switches do not always require the body diodes in view of the operation of the present invention. Further, first and second diodes D1 and D2 are preferably high speed switching diodes. Preferably, a resonant inductor L is an unsaturated inductor, which is linearly operated within the range of a panel drive operating current. The resonant inductor L can be replaced by leakage inductance of a transformer. Preferably, the transformer (N1:N2) is a high frequency transformer in which the number of turns of a primary side is N1 and the number of turns of a secondary side is N2. A PDP is represented by an equivalent circuit modeled upon a parallel circuit that consists of a current source indicating a discharge current and a capacitance C with a certain value. In the embodiment of FIG. 5, only one side circuit is depicted. The same circuit as that of FIG. 5 can be arranged on the opposite side of the panel and can be operated using the same principle and driving manner as the circuit of FIG. 5. The circuit of FIG. 5 represents the first embodiment of the present invention, and other embodiments, which will be described later, are different from the first embodiment in the positions of elements and the constructions of circuits, but they follow the same technical spirit as the first embodiment in operating principles and driving manners. Accordingly, other embodiments can be easily understood from the principles of the first embodiment.

Provided that the first embodiment represents an ideal circuit without taking system loss into consideration, and the turn ratio of the transformer is 1:2, the voltage between both ends of a panel capacitance C becomes equal to the input voltage at the time the current of the resonant inductor L passes through a maximum point from "0" and then becomes "0" at the time of resonance. However, in an actual system, loss occurs and all elements are not ideal, so the turn ratio of the transformer must be optimally designed to increase the voltage between both ends of the panel capacitance up to the input voltage. In consideration of system loss, the turn ratio of the transformer can be optimally calculated. The circuit proposed in this embodiment enables 100% zero voltage switching of inverter clamping switches SW3 and SW4 and solves an EMI noise problem, because the turn ratio of the transformer is optimally designed and so the voltage between both ends of the panel capacitance C can increase up to the input voltage. Further, while the capacitance C is charged/discharged, some energy is recovered to the input voltage source through the regenerative transformer, so energy recovery can be achieved without an additional element (for example, a very large capacitor bank DC in the second conventional circuit).

In FIGS. 13*a* to 13*e*, the operations of the energy recovery driving circuit according to the first embodiment of the present invention of FIG. 5 are depicted. Reference numerals are indicated on the basis of FIG. 5.

First Operating Mode: Turn-On Operation of First Switch SW1

Figure 13A:
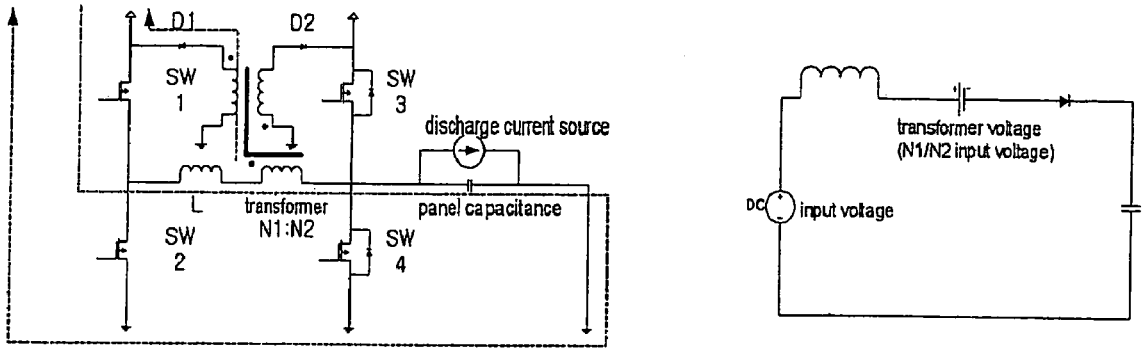
FIG. 13*a* to 13*e* are circuit diagrams showing operations according to modes of the energy recovery driving circuit according to the first embodiment of the present invention.

As shown in FIG. 13*a*, if the voltage of the panel capacitance C is "0", the first switch SW1 is turned on to allow the input voltage, the resonant inductor L, the voltage induced in the transformer, and the panel capacitance C to be connected in series with each other, thus causing serial resonance. The input voltage is reflected in the primary side F according to the number of turns thereof by a current flowing through the primary side F of the transformer, and a current corresponding to the number of turns of the secondary side S1 is recovered to the input voltage source. In the case of an ideal system, if the sum of the input voltage and the voltage induced in the transformer becomes ½ of the input voltage, the voltage of the panel capacitance increases up to the input voltage at the time the current of the resonant inductor L becomes "0" and it is necessary to turn on the third switch SW3, which is an inverter clamping switch. However, system loss actually exists, so the turn ratio of the transformer is designed such that the sum of the input voltage and the voltage induced in the transformer is greater than ½ of the input voltage. That is, the turn ratio of the transformer is designed such that the number of turns N2 of the secondary side is greater than or equal to two times the number of turns N1 of the primary side. In this case, since a resonance voltage source is greater than ½ of the input voltage source, the voltage of the panel capacitance must resonate greater than the input voltage, but it is clamped to the input voltage by a body diode of the inverter clamping switch (the third switch SW3). At this time, if the third switch SW3 is turned on, 100% zero voltage switching is possible.

Second Operating Mode: Turn-On Operation of Body Diode of Third Switch SW3

Figure 13B:
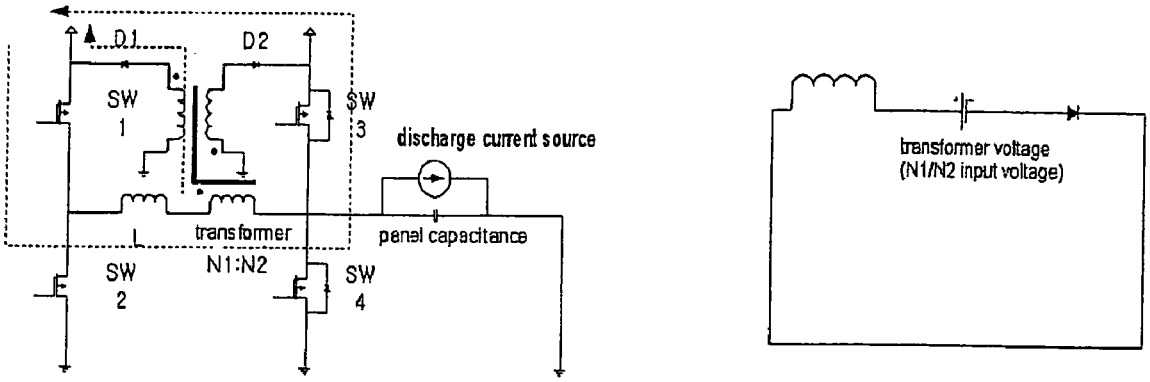

As shown in FIG. 13*b*, if the turn ratio of the transformer is designed to generate sufficient resonance energy, the third switch SW3 is turned on immediately after a body diode B3 of the third switch SW3 is turned on after the voltage of the panel capacitance C becomes the input voltage. In this case, by using a simple driving circuit for applying a drive voltage to the third switch SW3 after the voltage between both ends of the third switch SW3 becomes "0" while applying a drive pulse voltage to the third switch SW3 in advance, the drive of the third switch SW3 can be simply and accurately controlled. A plurality of techniques related to this switching control method have been proposed.

In this case, a current flowing through the resonant inductor L is linearly reduced due to the voltage induced in the transformer. After the current becomes "0", the current does not flow in reverse direction due to the first diode D1 of the secondary side S1 of the transformer. After that, a zero voltage switching is possible if the first switch SW1 is turned off. The current flowing through the resonant inductor L is recovered to the input voltage source through the secondary side S2 of the transformer while flowing through the first and third switches SW1 and SW3.

Third Operating Mode: Supply of Panel Discharge Current Through Third Switch SW3

Figure 13C:
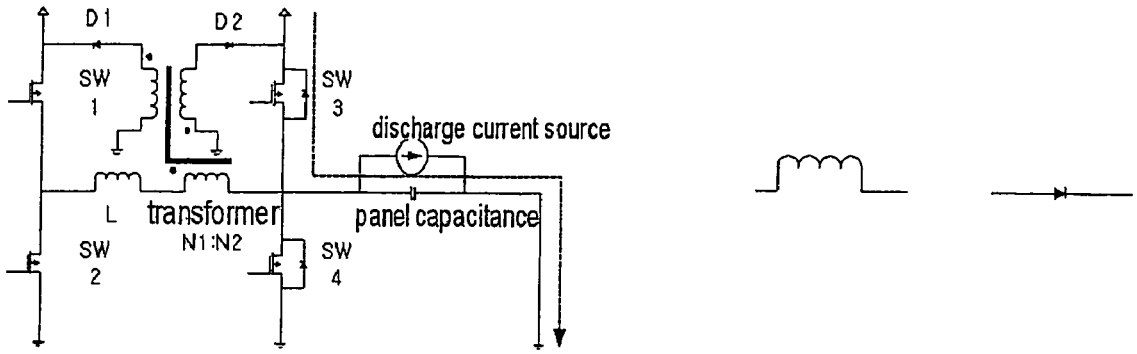

After that, the energy recovery driving circuit is not operated and supplies a discharge current to the panel through the third switch SW3 and another inverter switch on the opposite side when the panel is discharged by the input voltage applied to the panel (FIG. 13*c*).

Fourth Operating Mode: Turn-On Operation of Second Switch SW2

Figure 13D:
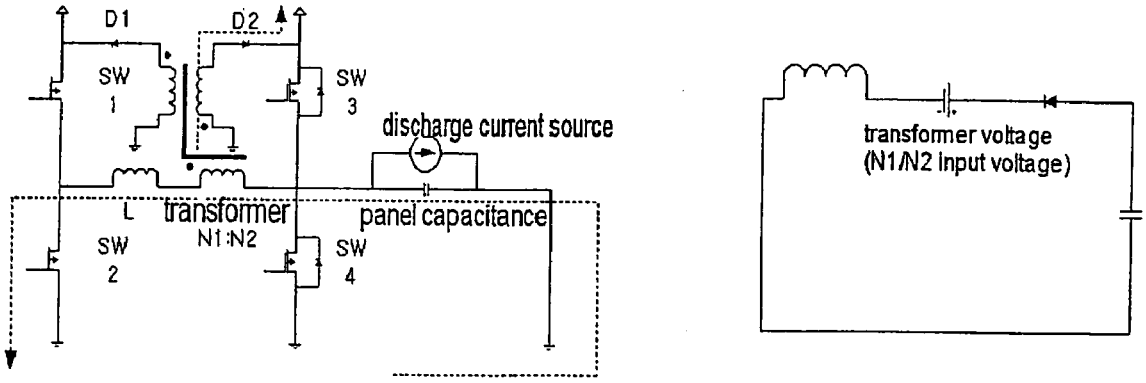

As shown in FIG. 13*d*, when the third switch SW3 is turned off, and then the second switch SW2 is turned on in the case where the voltage of the panel capacitance C is the input voltage, the resonant inductor L, the voltage induced in the transformer and the panel capacitance C are connected in series with each other, thus causing serial resonance. The input voltage is reflected in the primary side F according to the number of turns thereof by a current flowing through the primary side F of the transformer, and a current corresponding to the number of turns of the secondary side S2 is recovered to the input voltage source. In the case of an ideal system, if the voltage induced in the transformer is ½ of the input voltage, the voltage of the panel capacitance C falls to "0" at the time the current flowing through the resonant inductor L becomes "0", and it is necessary to turn on the fourth switch SW 4 which is the inverter clamping switch. However, since system loss actually exists, the turn ratio of the transformer is designed such that the voltage induced in the transformer is less than ½ of the input voltage. That is, the turn ratio of the transformer is designed such that the number of turns N2 of the secondary side S2 is greater than or equal to two times the number of turns N1 of the primary side F. In this case, since the resonance voltage source is less than ½ of the input voltage source, the panel voltage must resonate less than a zero voltage. However, the panel voltage is clamped to the zero voltage by a body diode B4 of the fourth switch SW4 which is the inverter clamping switch. At this time, if the fourth switch SW4 is turned on, 100% zero voltage switching is possible.

Fifth Operating Mode: Turn-On Operation of Body Diode of Fourth Switch SW4

Figure 13E:
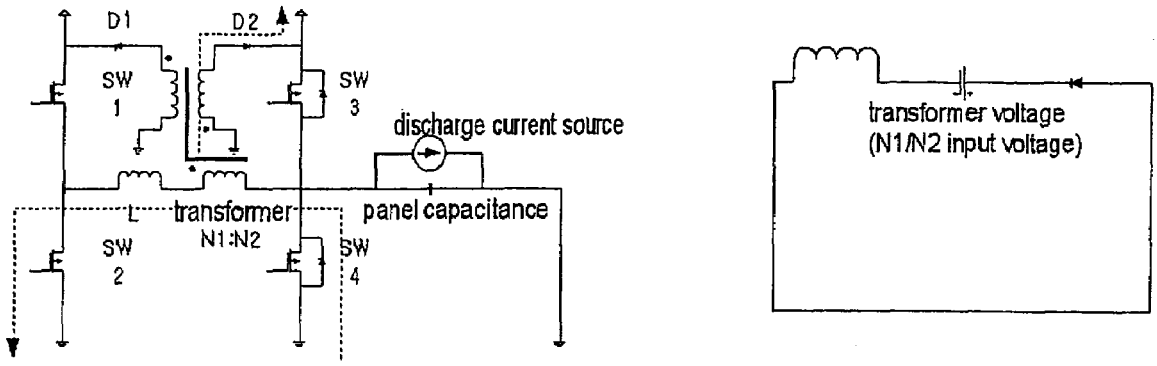
Figure 14A:
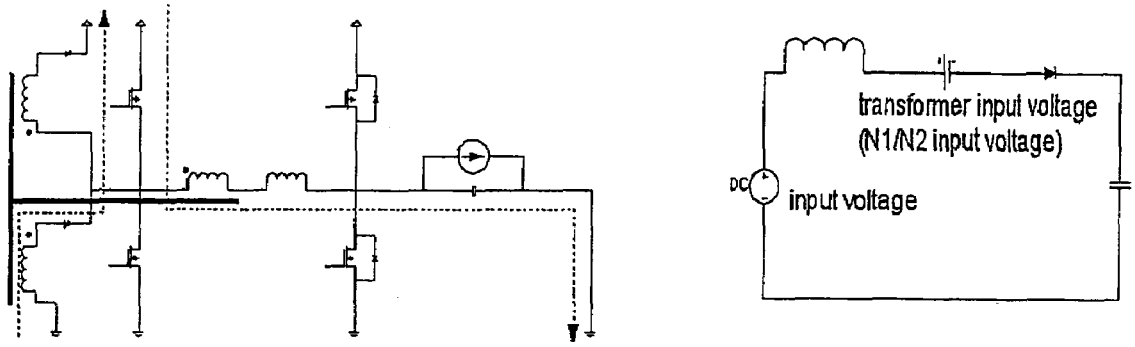
FIG. 14*a* to 14*e* are circuit diagrams showing operations according to modes of the energy recovery driving circuit according to the second embodiment of the present invention.
Figure 14B:
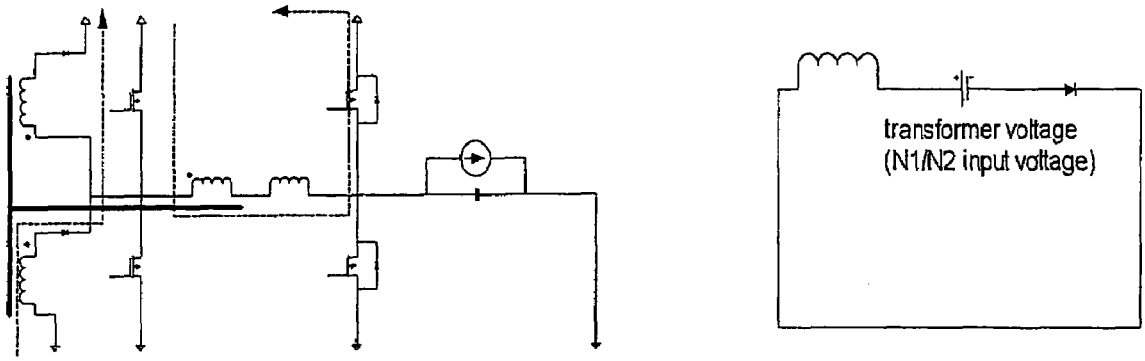
Figure 14C:
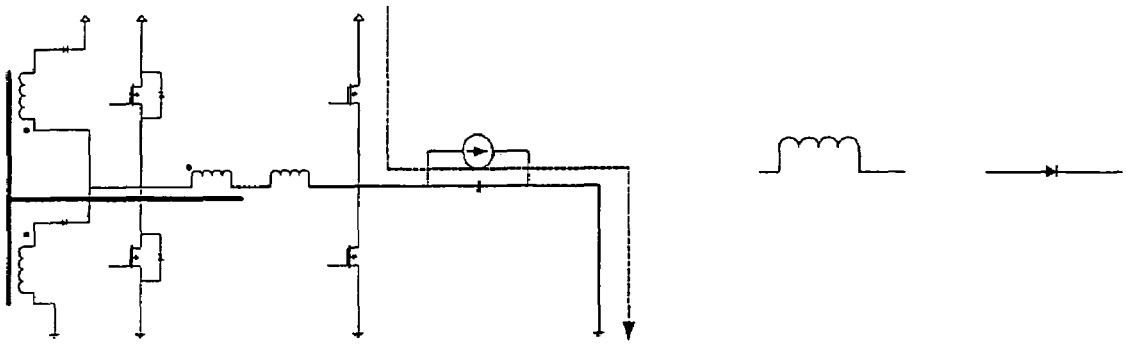
Figure 14D:
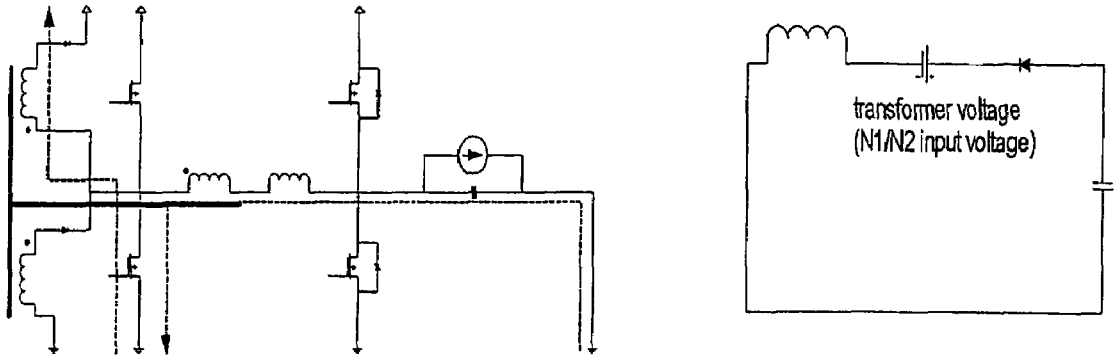
Figure 14E:
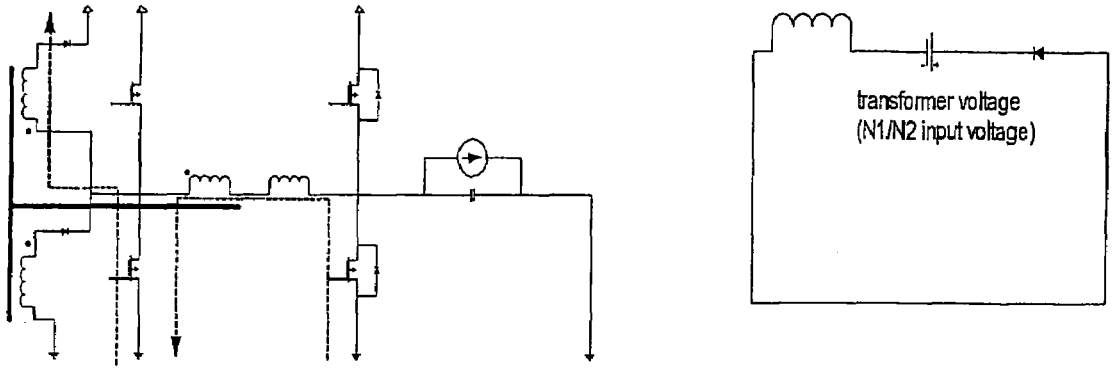
Figure 15A:
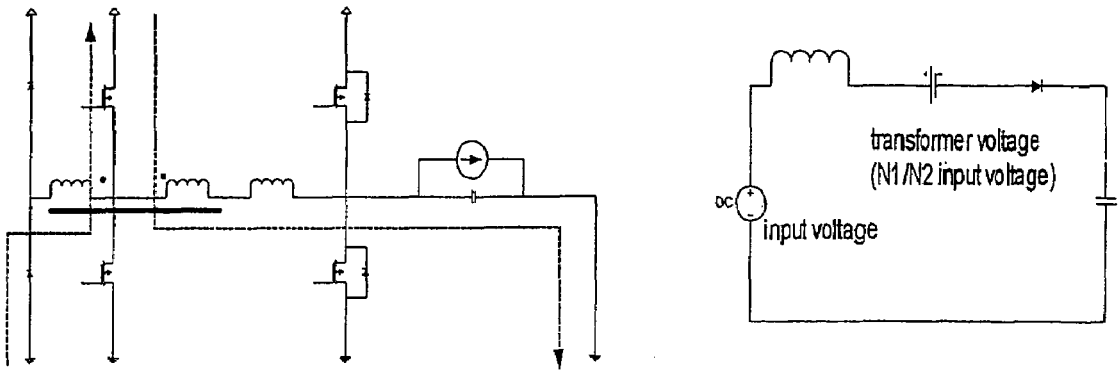
FIG. 15*a* to 15*e* are circuit diagrams showing operations according to modes of the energy recovery driving circuit according to the third embodiment of the present invention.
Figure 15B:
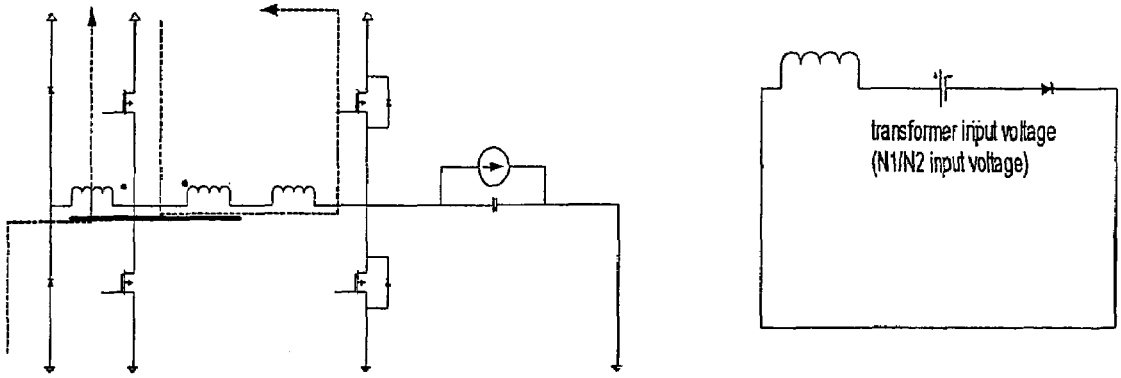
Figure 15C:
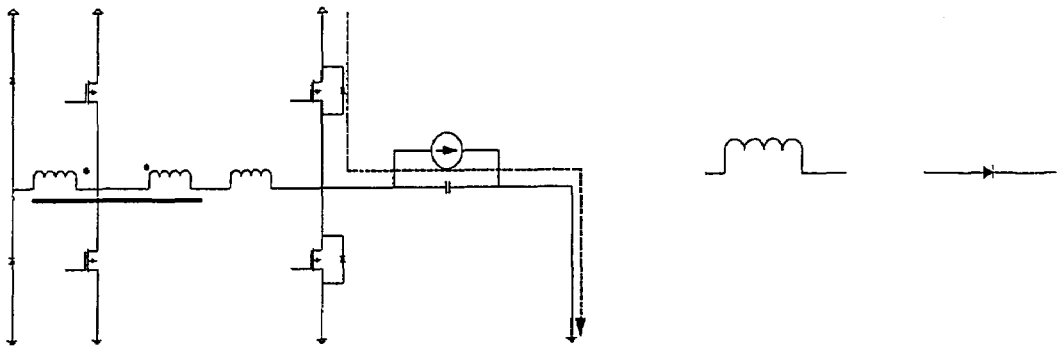
Figure 15D:
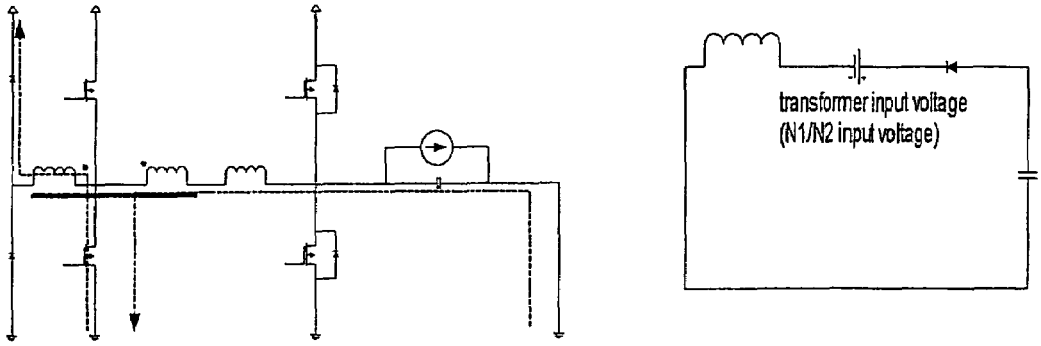
Figure 15E:
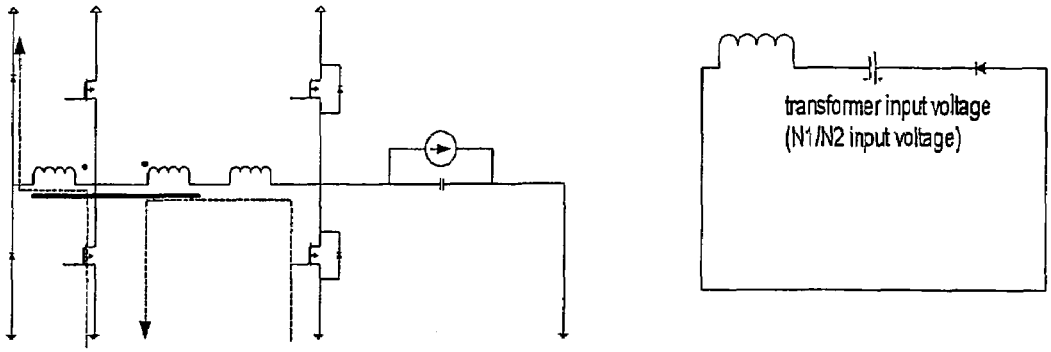
Figure 16A:
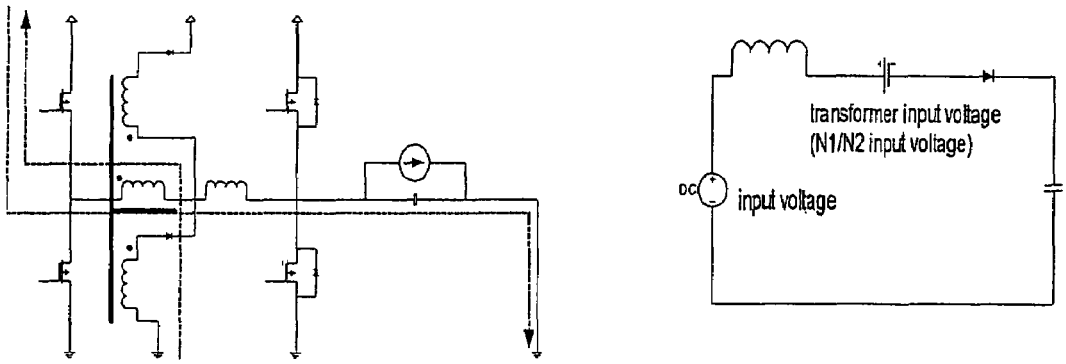
FIG. 16*a* to 16*e* are circuit diagrams showing operations according to modes of the energy recovery driving circuit according to the fourth embodiment of the present invention.
Figure 16B:
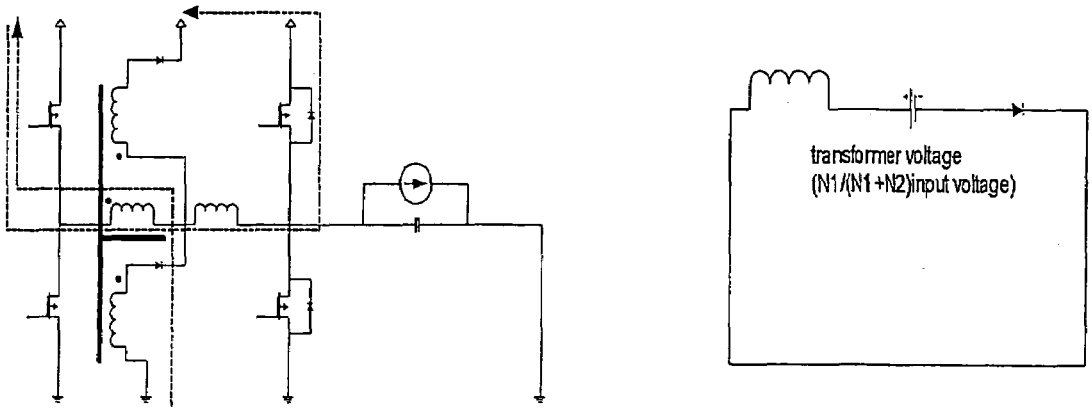
Figure 16C:
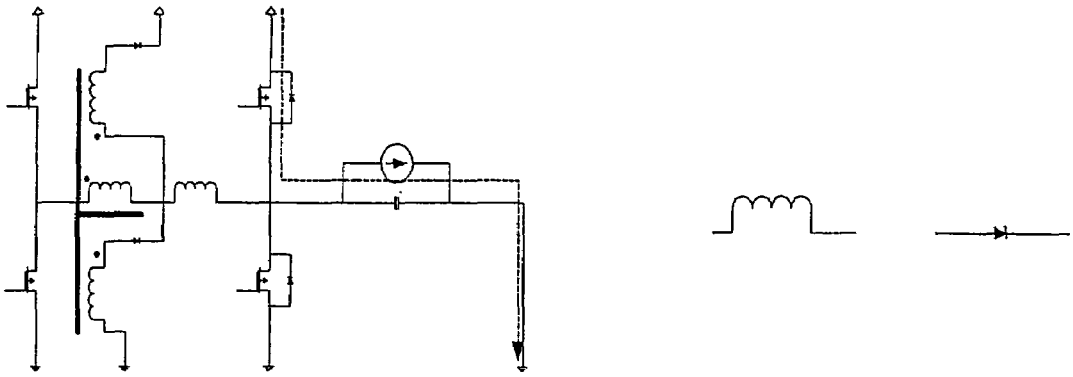
Figure 16D:
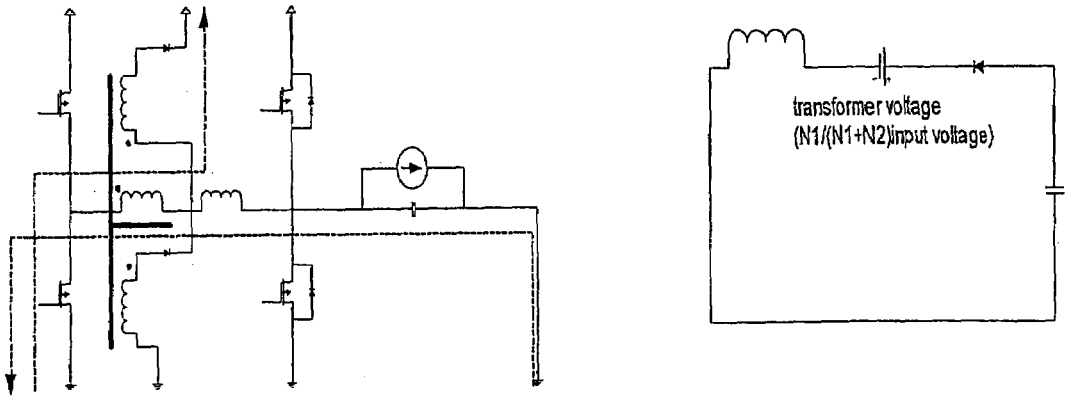
Figure 16E:
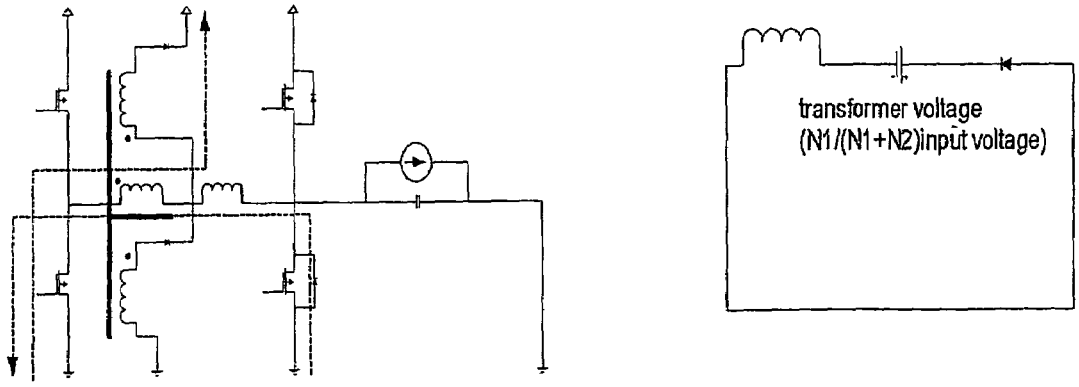
Figure 17A:
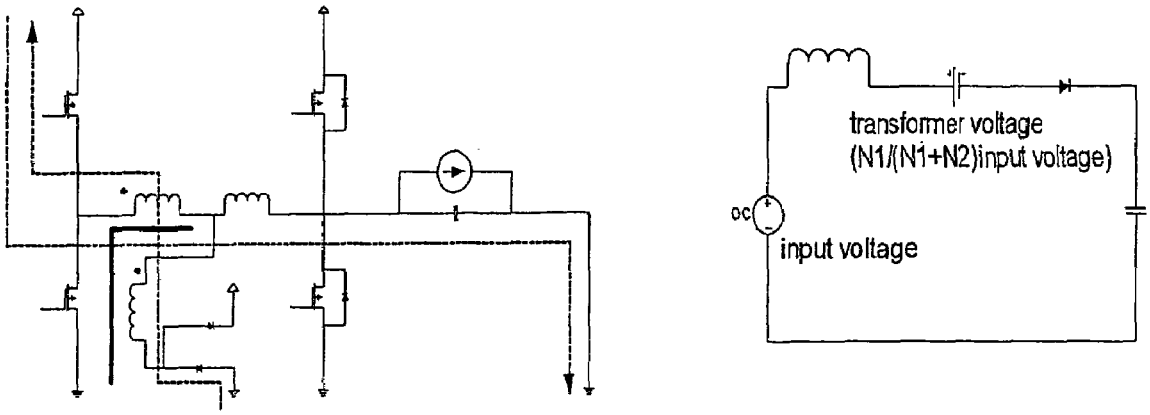
FIG. 17*a* to 17*e* are circuit diagrams showing operations according to modes of the energy recovery driving circuit according to the fifth embodiment of the present invention.
Figure 17B:
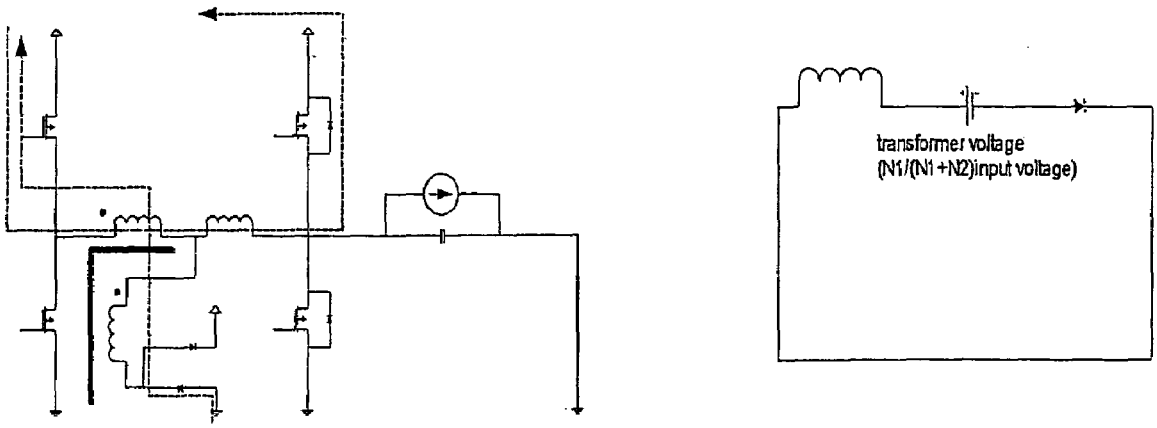
Figure 17C:
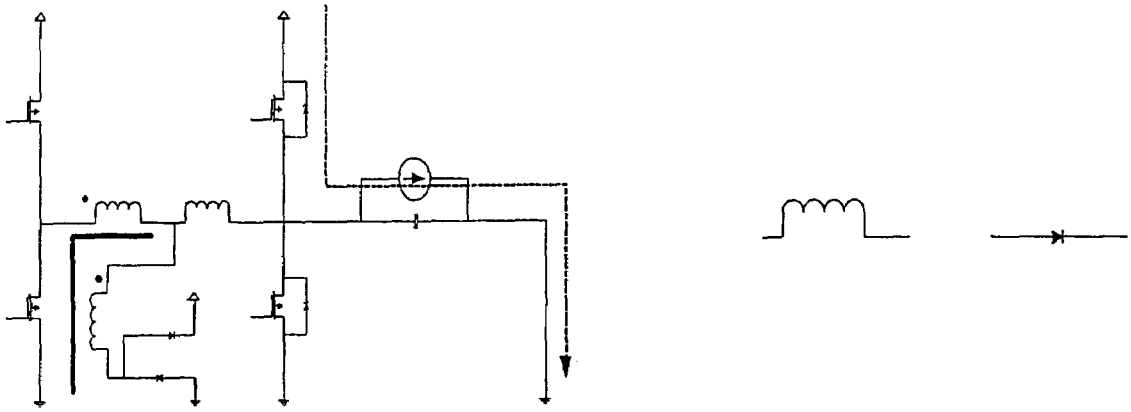
Figure 17D:
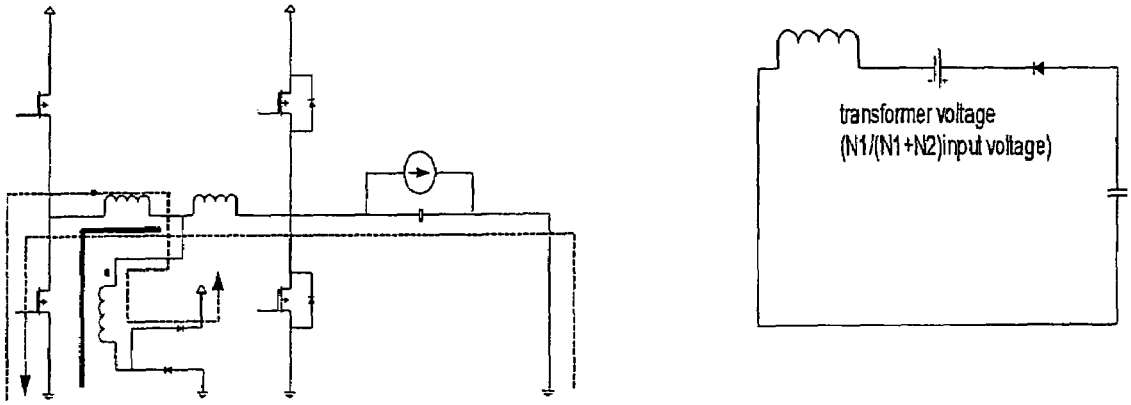
Figure 17E:
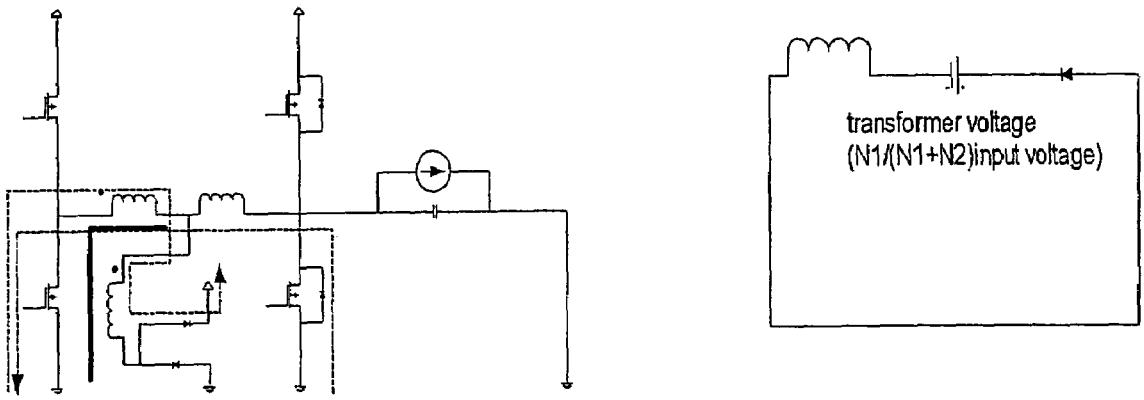

As shown in FIG. 13*e*, if the turn ratio of the transformer is designed to generate sufficient resonance energy, the fourth switch SW4 is turned on immediately after the body diode B4 of the fourth switch SW4 is turned on after the voltage of the panel capacitance C becomes "0". In this case, by using a simple driving circuit for applying a drive voltage to the fourth switch SW4 after the voltage between both ends of the fourth switch SW4 becomes "0" while applying a drive pulse voltage to the fourth switch SW4 in advance, the drive of the fourth switch SW4 can be simply and accurately controlled. A plurality of techniques related to this method have been proposed.

In this case, a current flowing through the resonant inductor L is linearly reduced due to the voltage induced in the transformer. After the current becomes "0", the current does not flow in reverse direction due to the second diode D2 of the secondary side S2 of the transformer. After that, a zero current switching is possible if the second switch SW2 is turned off.

The current flowing through the resonant inductor L is recovered to the input voltage source through the secondary side S2 of the transformer while flowing through the second and fourth switches SW2 and SW4.

Sixth Operating Mode: Maintenance of Ground Voltage Through Fourth Switch SW4

Thereafter, the energy recovery driving circuit is not operated, and the panel voltage is maintained at the ground voltage by the fourth switch SW4. The above-described operations are equally repeated by another circuit on the opposite side of the energy recovery driving circuit.

FIG. 6 is a circuit diagram of a second energy recovery driving circuit according to a second embodiment of the present invention. As described above, the first embodiment employs a construction in which the resonance circuit and the input voltage source are separated by the regenerative transformer. In this case, voltage stresses on the first and second diodes D1 and D2 increase, and current stresses on the first and second switches SW1 and SW2 increase. If the position of the transformer is moved as shown in FIG. 6 so as to solve the stress problem, the voltage stresses on the first and second diodes D1 and D2 decrease to ½ of previous stresses, and the current stresses on the first and second switches SW1 and SW2 also decrease to ½ of previous stresses.

FIG. 7 illustrates a third embodiment of the present invention, in which center-tapped half-bridge windings of secondary sides S1 and S2 in the second embodiment of FIG. 6 are replaced by a full-bridge winding of a secondary side S. In this case, the transformer is simplified in structure and is convenient to manufacture. However, a current flows bidirectionally through the secondary winding S of the transformer two times.

FIG. 8 illustrates a fourth embodiment of the present invention, in which the position of a transformer changes to reduce current stress on a primary side of the transformer to ½. In this case, since a resonant inductor L must be inserted outside the transformer, leakage inductance of the transformer cannot be used as the resonant inductor, while the number of turns of a secondary side of the transformer is reduced to ½.

FIG. 9 illustrates a fifth embodiment of the present invention, in which center-tapped half-bridge windings of secondary sides S1 and S2 in the circuit of FIG. 8 are replaced by the full-bridge winding of a secondary side S as in the case of FIG. 7. In this case, the transformer is simplified in structure and is convenient to manufacture. However, a current flows bidirectionally through the secondary winding S of the transformer two times.

FIGS. 14*a* to 14*e* are circuit diagrams showing the operations of the second embodiment of the present invention shown in FIG. 6. FIGS. 14*a* to 14*e* correspond to the above-described first to fifth operating modes of the embodiment of FIG. 5, respectively, and they can be easily understood from the description of the operations of FIG. 5.

FIGS. 15*a* to 15*e* are circuit diagrams showing the operations of the third embodiment of the present invention shown in FIG. 7. FIGS. 15*a* to 15*e* correspond to the above-described first to fifth operating modes of the embodiment of FIG. 5, respectively, and they can be easily understood from the above description of the operations of FIG. 5.

FIGS. 16*a* to 16*e* are circuit diagrams showing the operations of the fourth embodiment of the present invention shown in FIG. 8. FIGS. 16*a* to 16*e* correspond to the above-described first to fifth operating modes of the embodiment of FIG. 5, respectively, and they can be easily understood from the above description of the operations of FIG. 5.

FIGS. 17*a* to 17*e* are circuit diagrams showing the operations of the fifth embodiment of the present invention shown in FIG. 9. FIGS. 17*a* to 17*e* correspond to the above-described first to fifth operating modes of the embodiment of FIG. 5, respectively, and they can be easily understood from the above description of the operations of FIG. 5.

As described above, the second to fifth embodiments of the present invention shown in FIGS. 14*a* to 14*e*, FIGS. 15*a* to 15*e*, FIGS. 16*a* to 16*e*, and FIGS. 17*a* to 17*e*, respectively, can be easily understood from the operations of the first embodiment, which are described with reference to FIGS. 13*a* to 13*e*, so detailed description thereof is omitted.

FIG. 10 illustrates a sixth embodiment of the present invention. The first embodiment of FIG. 5 is an input voltage feedback type, while the sixth embodiment is a capacitance voltage feedback type in which the voltage of a panel capacitance C is reflected in a transformer. This embodiment is additionally advantageous in that current stress imposed on a resonant inductor L is reduced. When a resonance circuit is designed, it must be considered that the impedance of the panel capacitance is reflected in the transformer. Operating modes are described below.

FIG. 11 illustrates a seventh embodiment of the present invention, in which center-tapped half-bridge windings of secondary sides S1 and S2 in the circuit of FIG. 10 are replaced by a full-bridge winding of a secondary side S as in the case of FIG. 7. In this case, the transformer is simplified in structure and is convenient to manufacture. However, a current flows bidirectionally through the secondary winding S of the transformer two times.

Hereinafter, the sixth embodiment of the present invention of FIG. 10 is described in detail with reference to FIGS. 18*a* to 18*e*.

First Operating Mode: Turn-On Operation of First Switch SW1

As shown in FIGS. 18*a* to 18*e*, if the voltage of the panel capacitance C is "0", a first switch SW1 is turned on to allow an input voltage, a resonant inductor L, a capacitance voltage induced in a transformer, and the panel capacitance C to be connected in series with each other, thus causing serial resonance. The voltage and impedance of the panel capacitance C is reflected in a secondary side S1 according to the number of turns thereof by a current flowing through the primary side F of the transformer. The secondary side S1 charges the panel capacitance C by a current corresponding to the number of turns thereof. In the case of an ideal system, if the sum of the voltage of the panel capacitance C and the voltage induced in the transformer becomes two times the voltage of the panel capacitance C, the panel voltage increases up to the input voltage at the time the current of the resonant inductor L passes through a maximum value from "0" and then becomes "0" again, and it is necessary to turn on a third switch SW3, which is an inverter clamping switch. However, system loss actually exists, so the turn ratio of the transformer is designed such that the sum of the voltage of the panel capacitance and the voltage induced in the transformer is less than two times the voltage of the panel capacitance C. That is, the turn ratio of the transformer is designed such that the number of turns N2 of the secondary side is greater than or equal to the number of turns N1 of the primary side. In this case, since the maximum value of the sum of the voltage of the panel capacitance C and the voltage induced in the transformer is less than the voltage of input voltage source, the panel voltage must resonate greater than the input voltage, but the panel voltage is clamped to the input voltage by a body diode B3 of the third switch SW3 which is the inverter clamping switch. At this time, if the third switch SW3 is turned on, 100% zero voltage switching is possible.

Second Operating Mode: Turn-On Operation of Body Diode of Third Switch SW3

Figure 18A:
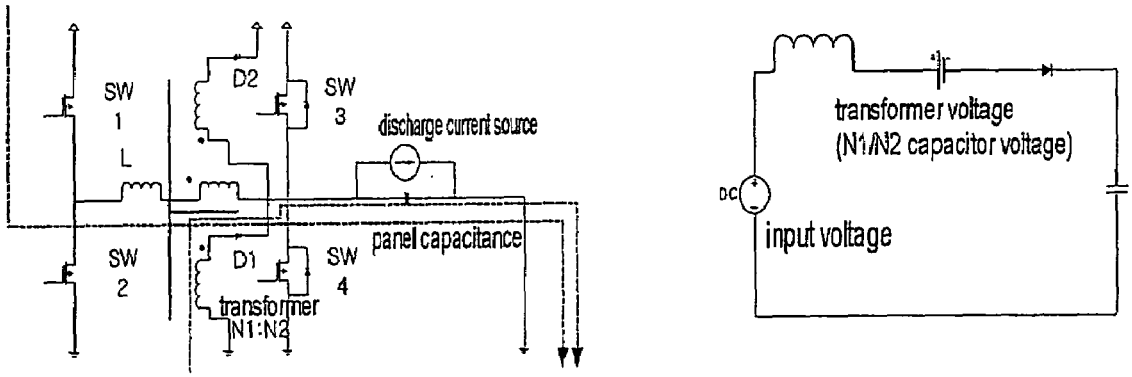
FIG. 18*a* to 18*e* are circuit diagrams showing operations according to modes of the energy recovery driving circuit according to the sixth embodiment of the present invention.
Figure 18B:
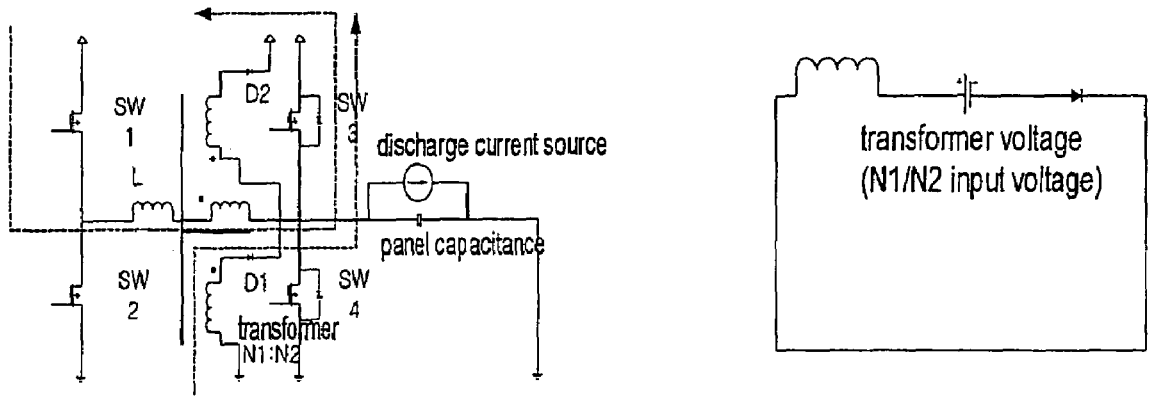

As shown in FIG. 18*b*, if the turn ratio of the transformer is designed to generate sufficient resonance energy, the third switch SW3 is turned on immediately after the body diode B3 of the third switch SW3 is turned on after the voltage of the panel capacitance C becomes the input voltage. In this case, by using a simple driving circuit for applying a drive voltage to the third switch SW3 after the voltage between both ends of the third switch SW3 becomes "0" while applying a drive pulse voltage to the third switch SW3 in advance, the drive of the third switch SW3 can be simply and accurately controlled. A plurality of techniques related to this method have been proposed.

In this case, the current flowing through the resonant inductor L is linearly reduced due to the voltage induced in the transformer. After the current becomes "0", the current does not flow in reverse direction due to the first diode D1. After that, if the first switch SW1 is turned off, a zero current switching is possible. The current flowing through the resonant inductor L is recovered to the input voltage source through the secondary side S1 of the transformer while flowing through the first and third switches SW1 and SW3.

Third Operating Mode: Supply of Panel Discharge Current Through Third Switch SW3

Figure 18C:
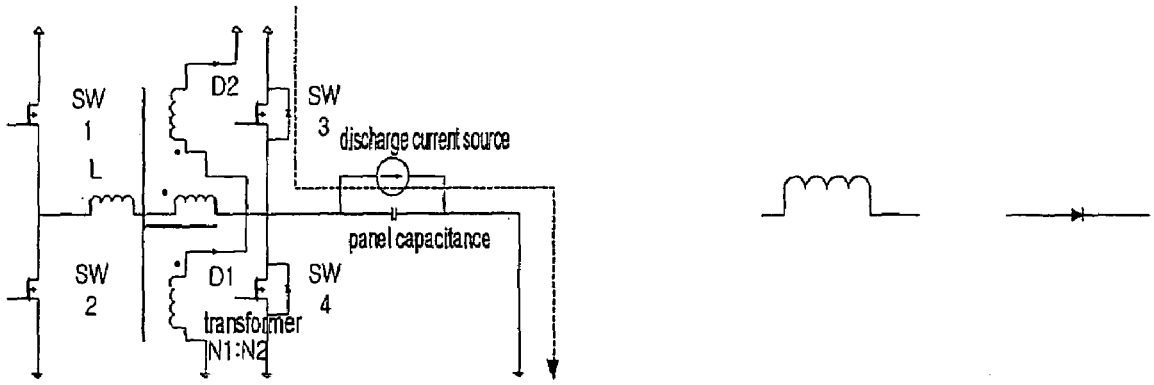

After that, the energy recovery driving circuit is not operated and supplies a discharge current to the panel through the third switch SW3 and another inverter switch on the opposite side when the panel is discharged by the input voltage applied to the panel (FIG. 18*c*).

Fourth Operating Mode: Turn-On Operation of Second Switch SW2

Figure 18D:
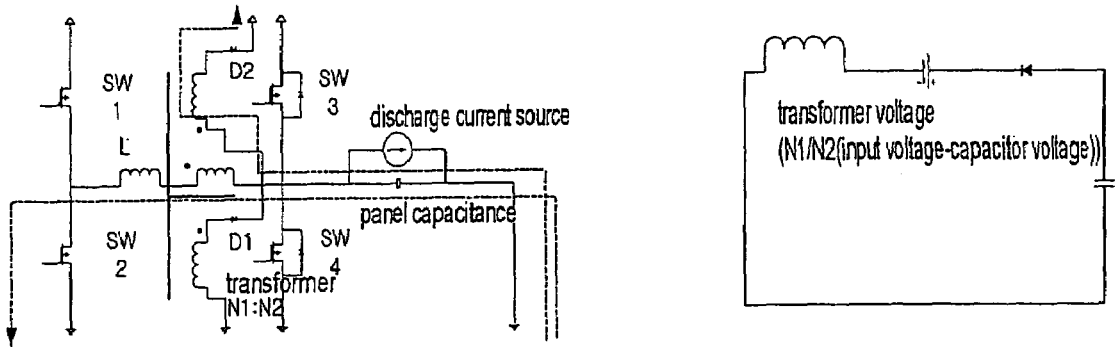

As shown in FIG. 18*d*, when the third switch SW3 is turned off, and then the second switch SW2 is turned on in the case where the voltage of the panel capacitance C is the input voltage, the resonant inductor L, the voltage induced in the transformer, and the panel capacitance C are connected in series with each other, thus causing serial resonance. A voltage obtained by subtracting the voltage of the panel capacitance from the input-voltage is reflected in the primary side F according to the number of turns thereof by a current flowing through the primary side F of the transformer. A current corresponding to the number of turns of the secondary side S2 is recovered to the input voltage source. In the case of an ideal system, if the sum of the voltage of the panel capacitance and the voltage induced in the transformer is a voltage obtained by subtracting two times the panel capacitance voltage from the input voltage, the voltage of the panel capacitance C falls to "0" at the time the current flowing through the resonant inductor L becomes "0", and it is necessary to turn on the fourth switch SW 4 which is the inverter clamping switch. However, since system loss actually exists, the number of turns N2 of the secondary side of the transformer is designed to be greater than or equal to the number of turns N1 of the primary side. In this case, the panel voltage must resonate less than a zero voltage, but it is clamped to the zero voltage by the body diode B4 of the fourth switch SW4 which is an inverter clamping switch. At this time, if the fourth switch SW4 is turned on, 100% zero voltage switching is possible.

Fifth Operating Mode: Turn-On Operation of Body Diode of Fourth Switch SW4

Figure 18E:
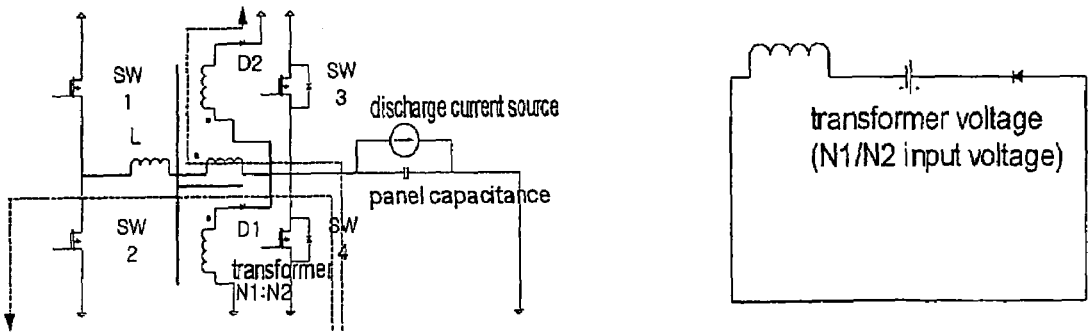
Figure 19A:
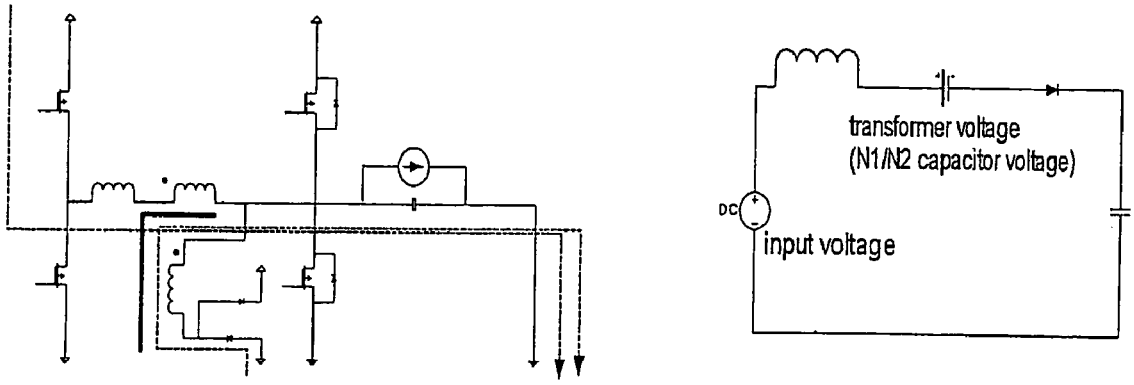
FIG. 19*a* to 19*e* are circuit diagrams showing operations according to modes of the energy recovery driving circuit according to the seventh embodiment of the present invention.
Figure 19B:
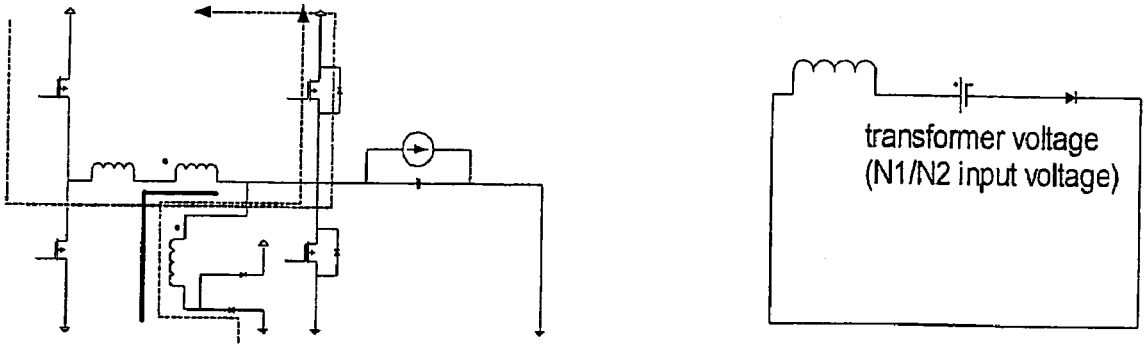
Figure 19C:
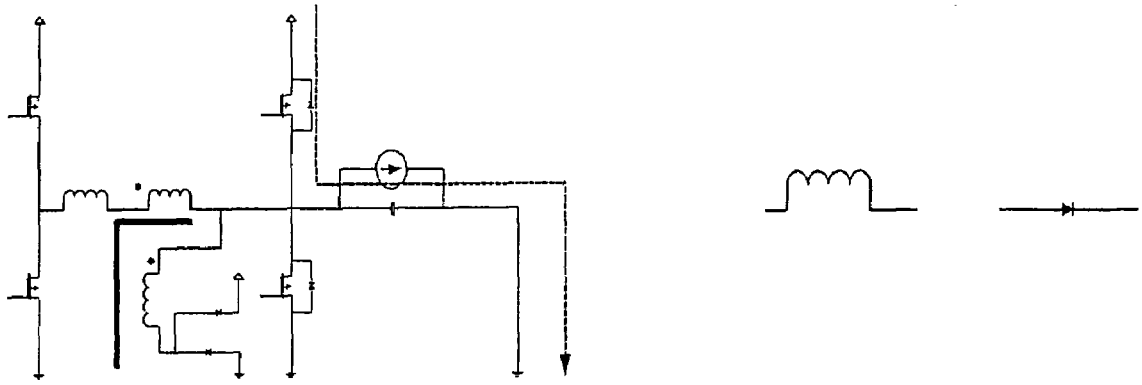
Figure 19D:
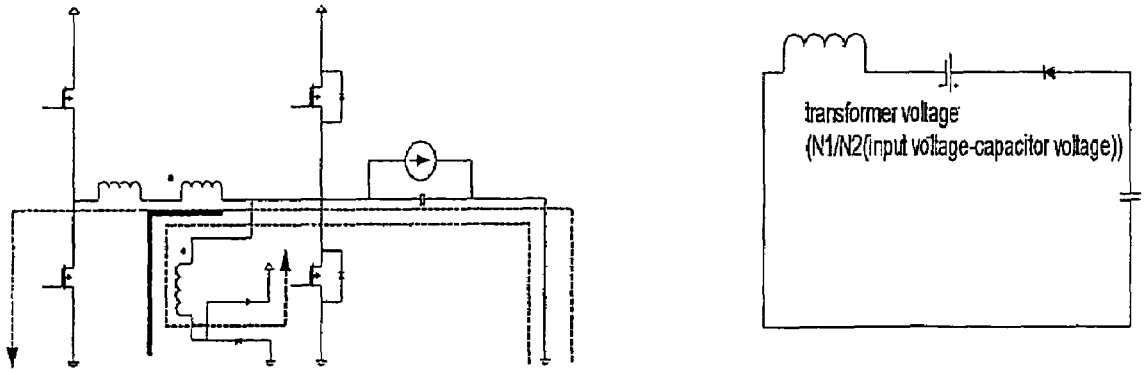
Figure 19E:
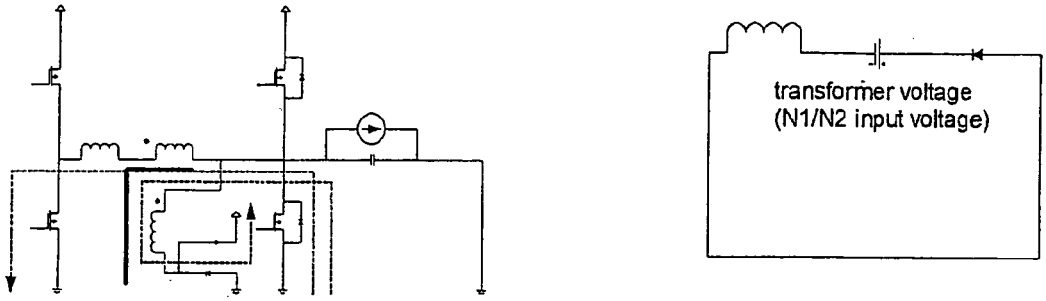

As shown in FIGS. 18*e*, if the turn ratio of the transformer is designed to generate sufficient resonance energy, the fourth switch SW4 is turned on immediately after the body diode B4 of the fourth switch SW4 is turned on after the voltage of the panel capacitance becomes "0". In this case, by using a simple driving circuit for applying a drive voltage to the fourth switch SW4 after the voltage between both ends of the fourth switch SW4 becomes "0" while applying a drive pulse voltage to the fourth switch SW4 in advance, the drive of the fourth switch SW4 can be simply and accurately controlled. A plurality of techniques related to this method have been proposed.

In this case, a current flowing through the resonant inductor L is linearly reduced due to the voltage induced in the transformer. After the current becomes "0", the current does not flow in reverse direction due to the second diode D2.

After that, a zero current switching is possible if the second switch SW2 is turned off.

The current flowing through the resonant inductor L is recovered to the input voltage source through the secondary side S2 of the transformer while flowing through the second and fourth switches SW2 and SW4.

Sixth Operating Mode: Maintenance of Ground Voltage Through Fourth Switch SW4

After that, the energy recovery driving circuit is not operated, and the panel voltage is maintained at the ground voltage by the fourth switch SW4. The above-described operations are equally repeated by another circuit on the opposite side of the energy recovery driving circuit.

FIGS. 19*a* to 19*e* are circuit diagrams showing the operations of the seventh embodiment of the present invention shown in FIG. 11. FIGS. 19*a* to 19*e* correspond to the first to fifth operating modes of the sixth embodiment of FIG. 10, respectively, and they can be easily understood from the above description of the operations for FIG. 10, so detailed description is omitted.

Figure 12:
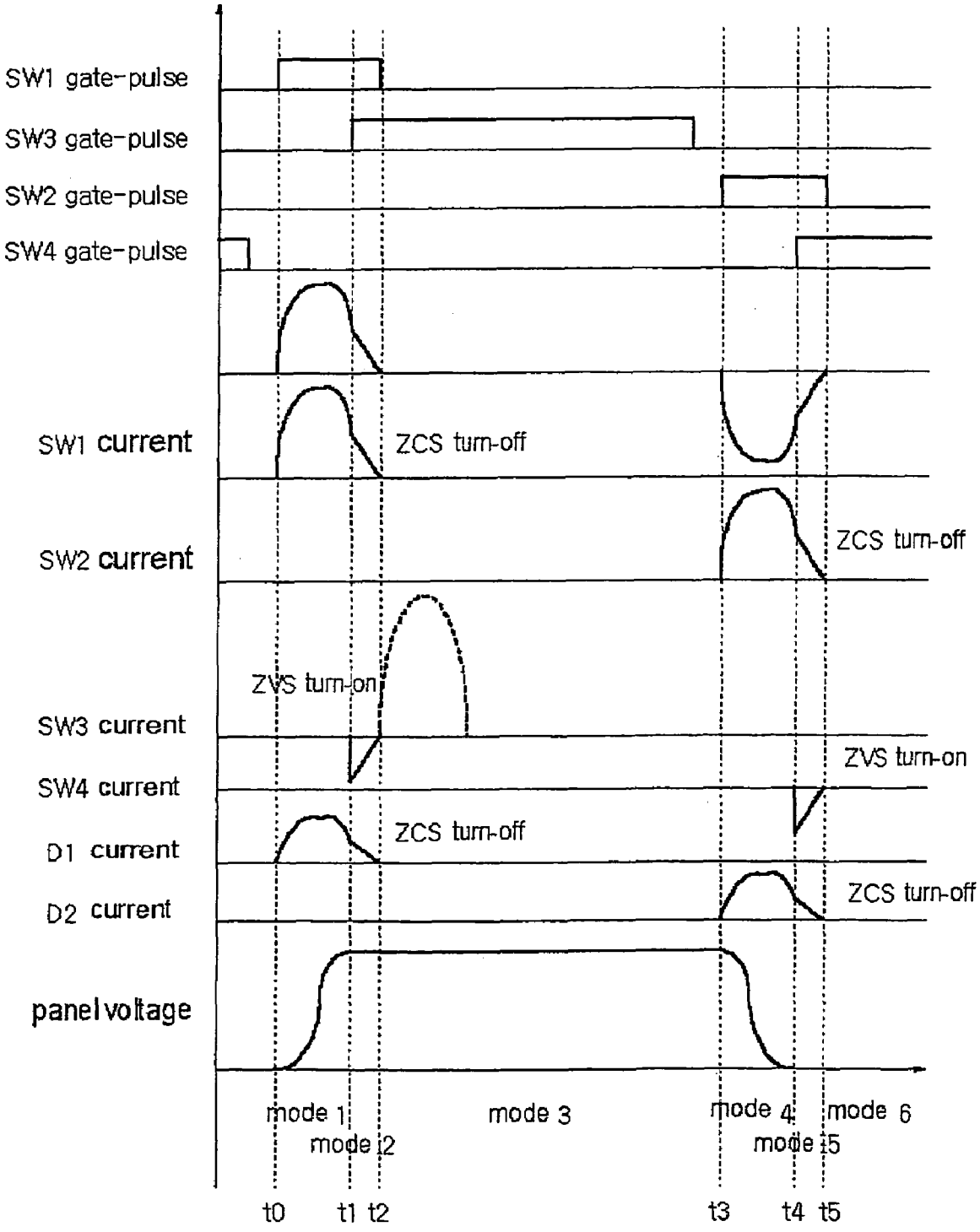
FIG. 12 is a waveform diagram showing an example of the operation of the energy recovery driving circuit according to the embodiments of the present invention.

FIG. 12 illustrates the control timing of switches for operating the energy recovery driving circuit according to the embodiment of the present invention. In FIG. 12, examples of control pulses applied to gates of first to fourth switches are depicted, and, additionally, currents flowing through respective switches and first and second diodes are depicted. Further, the panel voltage is depicted, and first to sixth modes depicted by dividing a time axis into six regions correspond to the above-described first to sixth operating modes, respectively.

The above-described construction and operation of the present invention can be applied to all Alternating Current (AC) driving circuits with capacitive loads. The application of the present invention is not limited to the driving circuits of the plasma display panel, which are mainly described above.

Further, the embodiments of the present invention shown in FIGS. 5 to 11 can be variously modified. Respective switching devices can be various switches performing similar operations, such as Field Effect Transistors (FETs), or Bipolar Junction Transistors (BJTs), and the voltage source can be a typical Direct Current (DC) voltage source, a capacitor voltage source, a capacitor with a large capacitance or the like. Those skilled in the art will appreciate that a difference between detailed designs due to the application of the embodiments is only simple design modification, and does not depart from the scope of the present invention.

Two-Level Energy Recovery Driving Circuit Using Regenerative Transformer

Figure 20A:
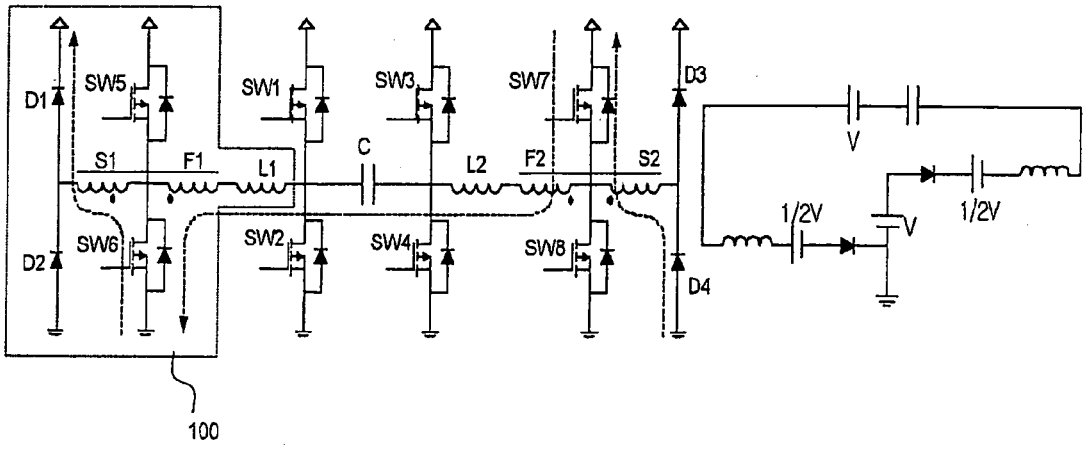
FIG. 20*a* to 20*d* are circuit diagrams showing operations according to modes and equivalent circuits of an eighth energy recovery driving circuit according to an eighth embodiment of the present invention.
Figure 20B:
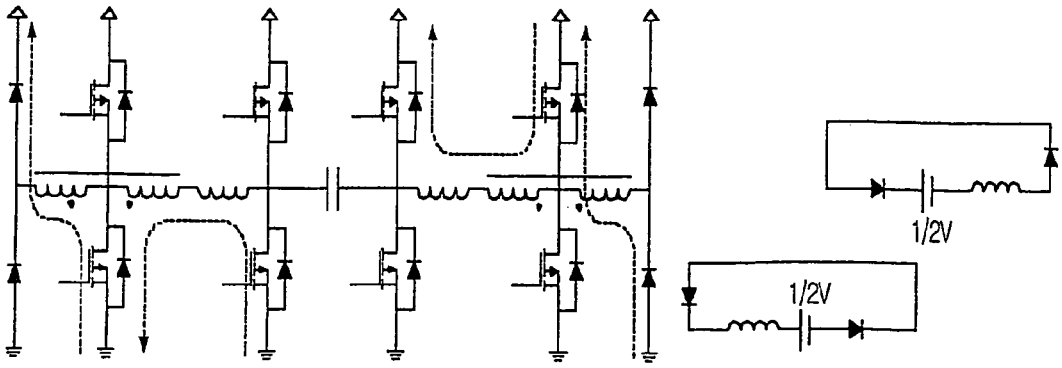

FIG. 20*a* to 20*e* are circuit diagrams showing the operation of a two-level energy recovery driving circuit according to an eighth embodiment of the present invention. The two-level energy recovery driving circuit represents an embodiment in which, after energy recovery circuits are symmetrically arranged on opposite sides on the basis of a load capacitance C, as shown in FIG. 20*a*, both the energy recovery circuits are operated at the time of charging/discharging the load capacitance, thus causing charging/discharging. The embodiment of FIG. 20*a* shows an example in which the energy recovery circuit 100 of FIG. 7 is employed on each of left and right sides of the load capacitance C. As such, the embodiment of FIG. 20*a* includes a first energy recovery unit including switches SW1, SW2 and diodes D1, D2, and a second energy recovery unit including switches SW3, SW4 and diodes D3, D4.

Figure 20C:
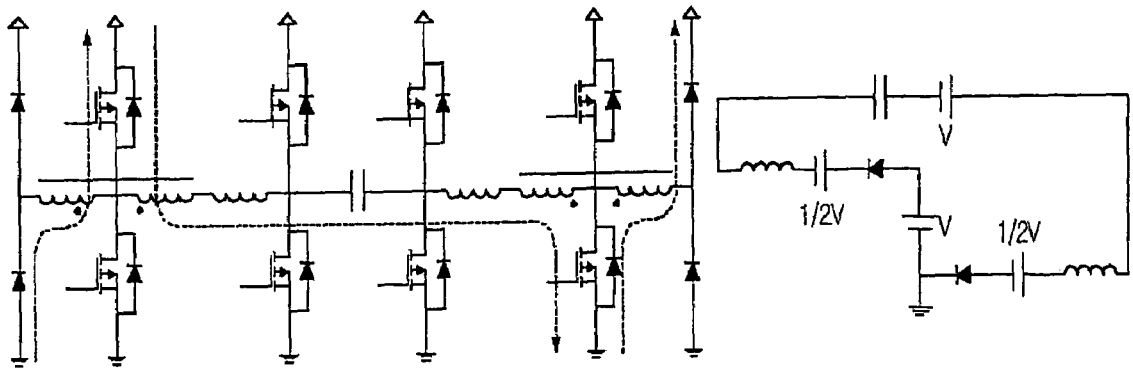
Figure 20D:
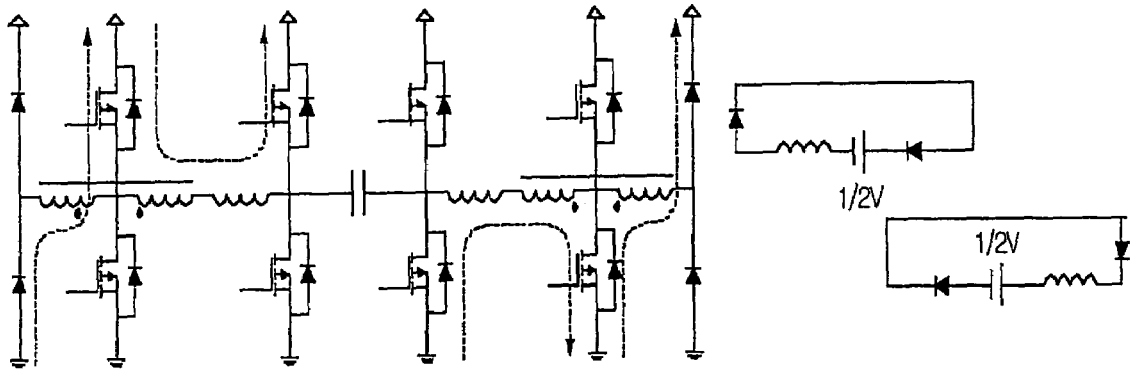

All of the above-described energy recovery driving circuits of the present invention can perform the same function as a conventional two-level energy recovery driving circuit in the case where charging and discharging are carried out by simultaneously operating both the energy recovery circuits after all AC voltage driving main switches (SW1 to SW4 of FIG. 20*a*) are turned off (FIG. 20*a* shows a charging process using both the energy recovery circuits, and FIG. 20*c* shows a discharging process).

FIGS. 20*a* to 20*d* are circuit diagrams showing operating modes (left sides of the drawings) of the energy recovery driving circuit and equivalent circuits (right sides of the drawings) in the respective operating modes when these two-level driving operations are performed.

Meanwhile, in the case of the two-level driving manner, energy recovery driving circuits on the left and right sides of the load employ separate transformers, respectively, as shown in FIG. 20*a*, so consequently two transformers are necessary. In order to overcome such complexity of the circuit, a simpler circuit is shown in FIG. 21*a*.

Figure 21A:
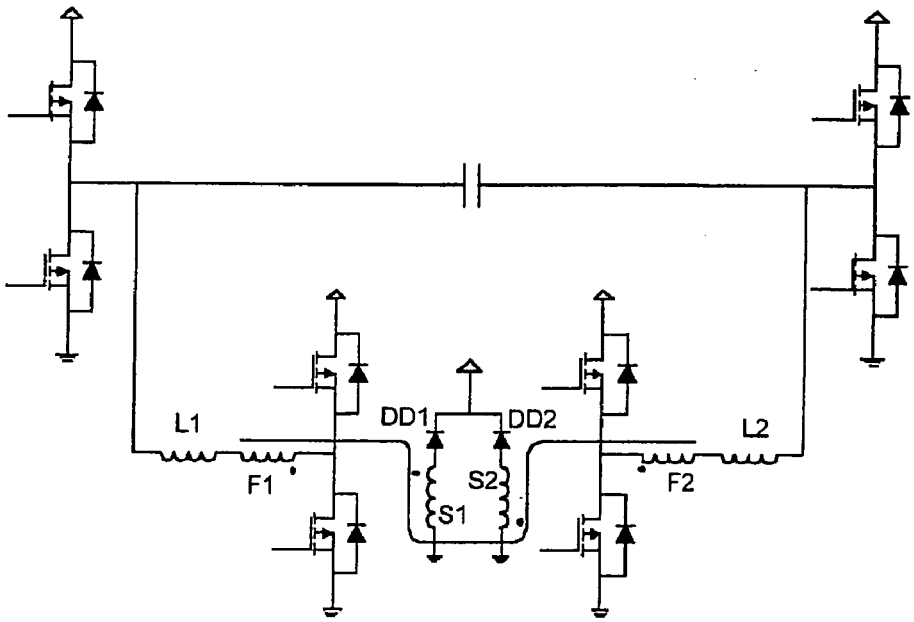
FIGS. 21*a* and 21*b* are circuit diagrams showing a ninth energy recovery driving circuit according to a ninth embodiment of the present invention, and an equivalent circuit thereof.
Figure 21B:
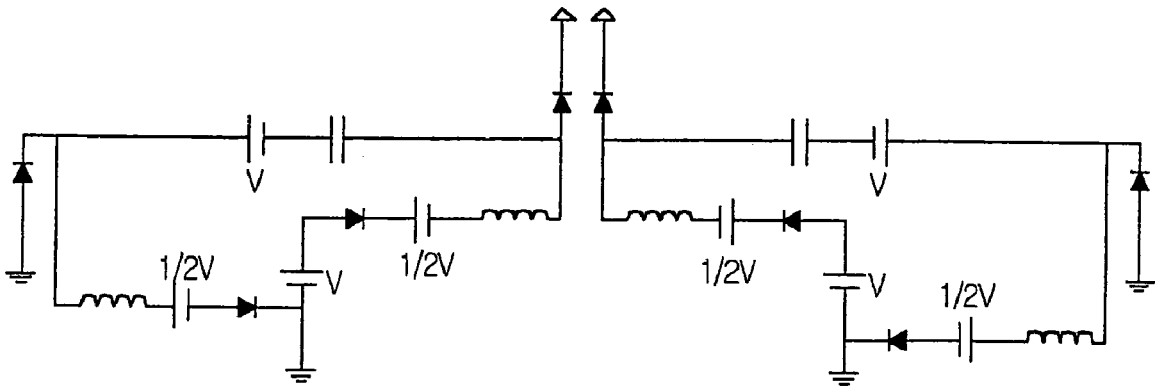

The embodiment of FIG. 21*a* shows an example in which a single transformer is used for a first transformer on the left side, provided with a primary coil F1 and a secondary coil S1, and a second transformer on the right side, provided with a primary coil F2 and a secondary coil S2 in the energy recovery driving circuit of FIG. 20*a*, so the construction of a circuit is simplified while the same function as in FIG. 20*a* is performed. FIG. 21*b* illustrates an equivalent circuit of the embodiment of FIG. 21*a*. In this case, by using an additional external small-sized voltage source without using an input voltage source, voltage stresses on the transformer and resonance auxiliary diodes can be reduced. If the circuit is implemented in this manner, since various external voltage sources actually exist in a complicated system, the energy recovery driving circuit can be more easily implemented. The advantages of the two-level driving manner of the proposed circuit are described below.

(1) It is possible to decrease the number of transformers to one from two.

(2) Stresses on the transformer and resonance auxiliary diode can be reduced and an optimal design can be achieved when an external voltage source is used.

Figure 22:
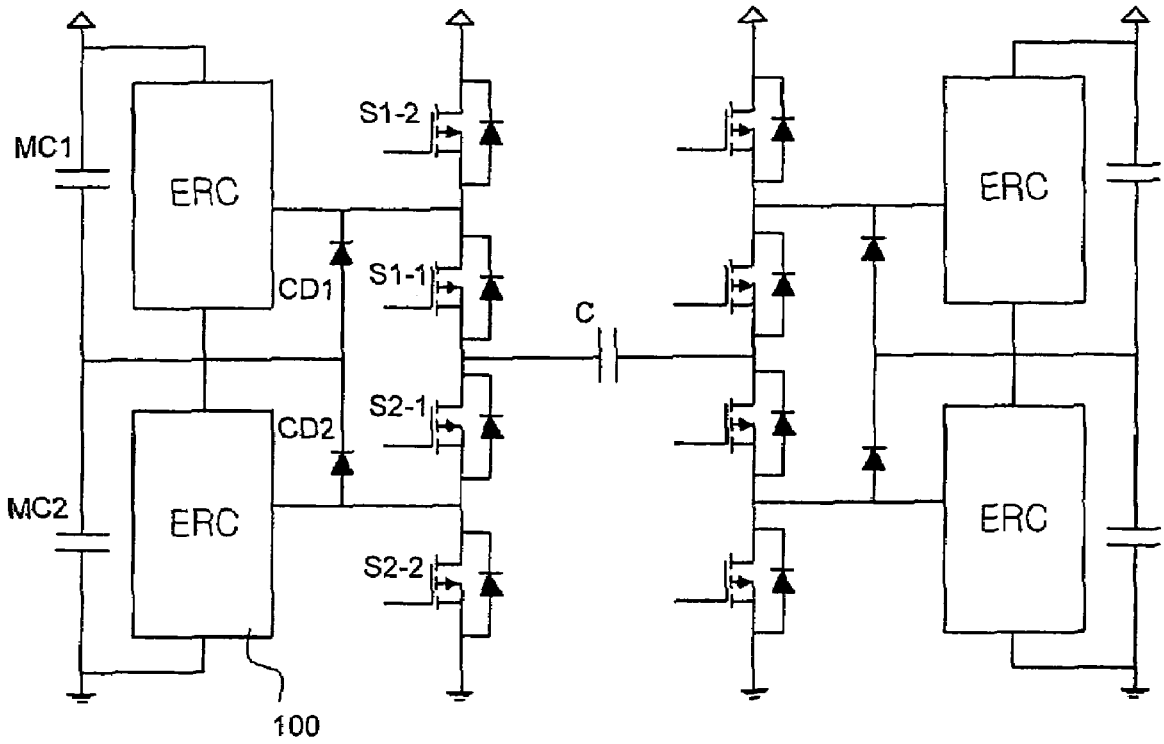
FIG. 22 is a conceptual view in which the energy recovery driving circuit of the present invention is applied to a multi-level driving circuit.

Application to Multi-Level Driving Circuit:

FIG. 22 is a conceptual view in which the energy recovery driving circuit using a regenerative transformer of the present invention is applied to a multi-level driving circuit. As shown in FIG. 22, the Energy Recovery Circuit (ERC) proposed in the present invention can be applied to a multi-level driving circuit. As shown in FIG. 22, the multi-level driving circuit consists of capacitors MC1 and MC2 using multiple voltages and clamping diodes CD1 and CD2 maintaining multiple voltages so as to enable low withstand voltage elements to be used at the time of driving a load C, and the energy recovery circuits 100 are inserted between multi-level voltage terminals and drive switches S1-1, S1-2, S2-1 and S2-2, as shown in FIG. 22.

Figure 23:
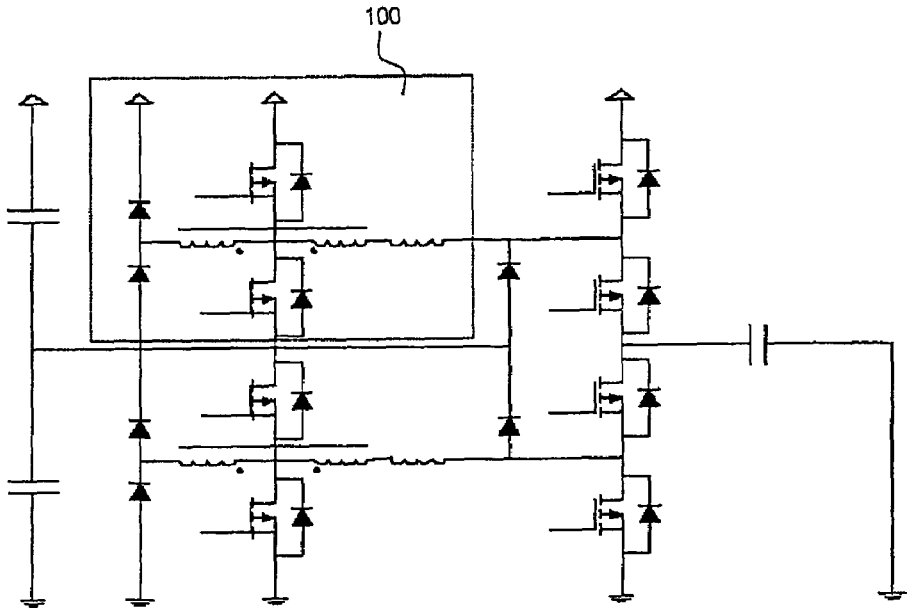
FIG. 23 is a circuit diagram showing an example in which the energy recovery driving circuit of the present invention is applied to a multi-level driving circuit.
Figure 24A:
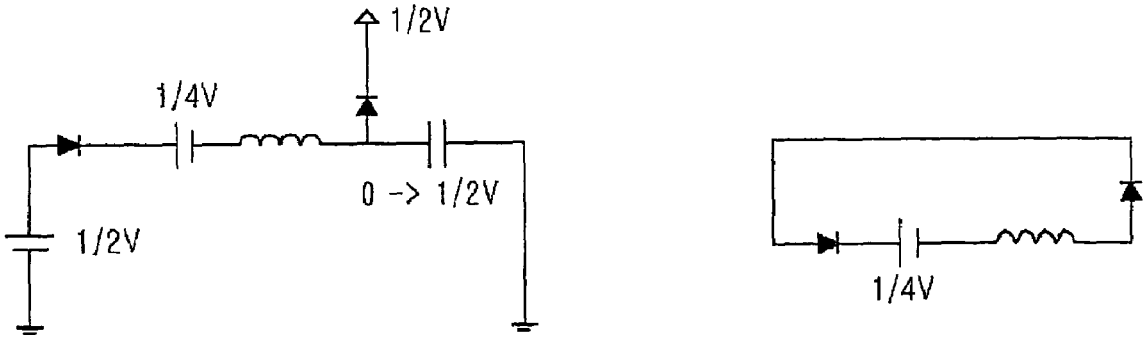
FIGS. 24*a* to 24*d* are circuit diagrams showing equivalent circuits to describe operations according to modes in the circuit of FIG. 23.
Figure 24B:
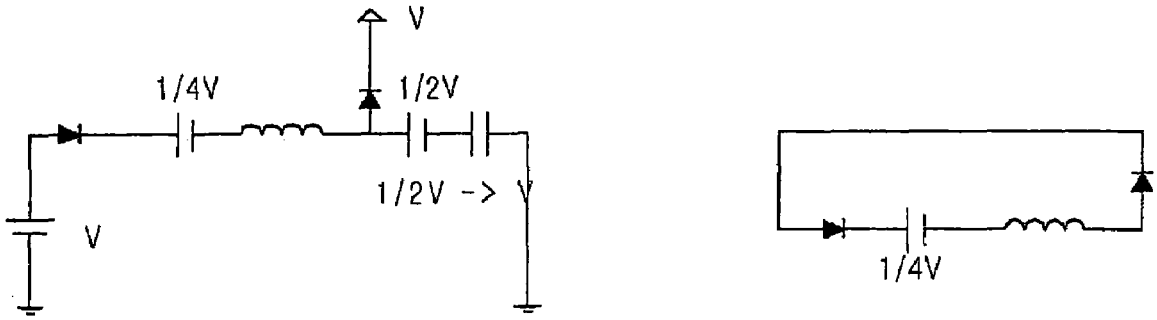
Figure 24C:
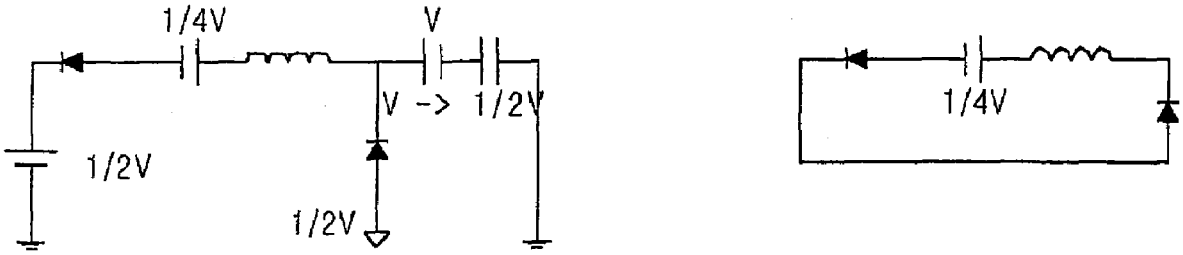
Figure 24D:
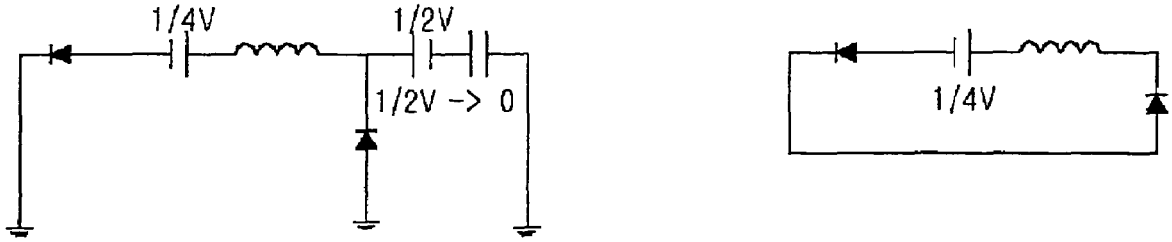

FIG. 23 is a circuit diagram showing an example in which the energy recovery driving circuit of the present invention is applied to a multi-level driving circuit. Each energy recovery circuit 100 used to implement the multi-level driving circuit is a similar type to the circuit shown in FIG. 7.

FIGS. 24*a* to 24*d* illustrate equivalent circuits of the circuit of FIG. 23 during charging/discharging operations according to operating modes (left sides of the drawings) and equivalent circuits thereof in respective modes (right sides of the drawings). In an operating mode of FIG. 24*a*, a charging process in which a charging voltage of a load capacitance C changes from 0 to V/2 is depicted, and in an operating mode of FIG. 24*b*, a charging process in which the charging voltage changes from V/2 to V is depicted. Further, in an operating mode of FIG. 24*c*, a discharging process in which a discharging voltage changes from V to V/2 is depicted, and in an operating mode of FIG. 24*d*, a discharging process in which the discharging voltage changes from V/2 to 0 is depicted.

Current Injection Driving Manner:

FIGS. 25*a* to 25*f* illustrate examples in which the energy recovery driving circuit of the present invention is driven in a current injection manner. Generally, all energy recovery circuits using voltage sources can be driven in the current injection manner. Therefore, all energy recovery circuits using a regenerative transformer, proposed in the present invention, can also be driven in the current injection manner. FIGS. 25*a* to 25*f* illustrate examples in which the energy recovery circuit of FIG. 7 is driven in the current injection manner.

Figure 25A:
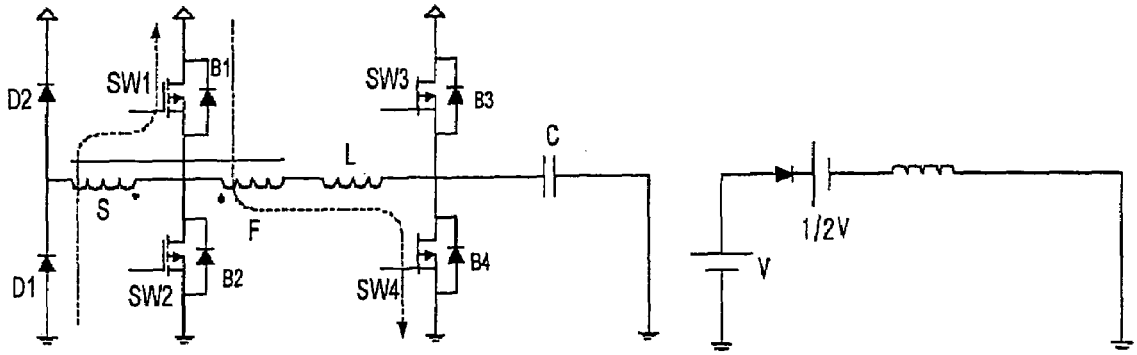
FIGS. 25*a* to 25*f* are circuit diagrams showing operations according to modes and equivalent circuits thereof when the energy recovery driving circuit of the present invention is driven in a current injection manner.
Figure 25B:
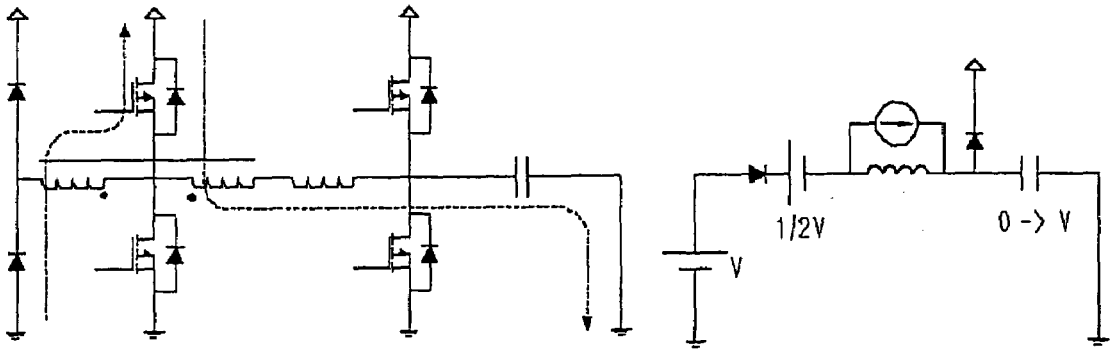
Figure 25C:
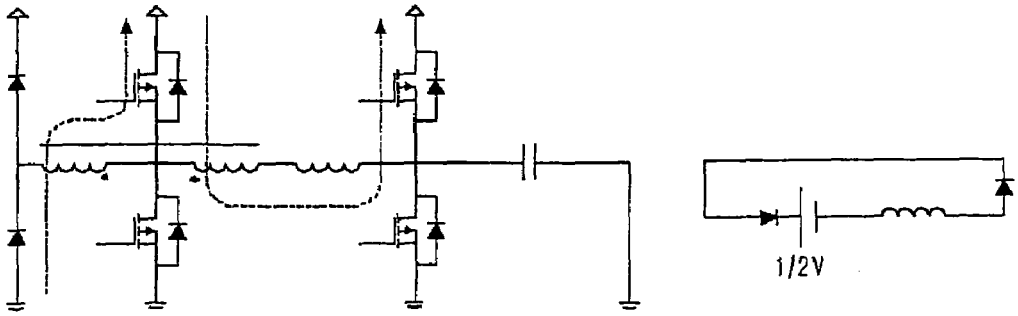
Figure 25D:
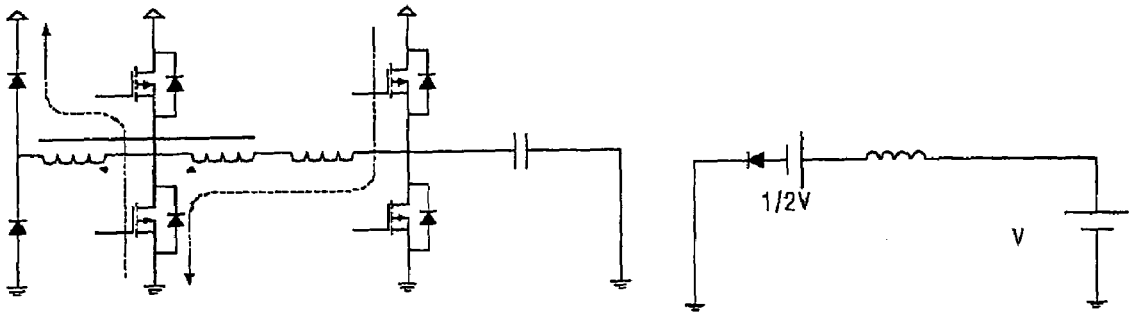
Figure 25E:
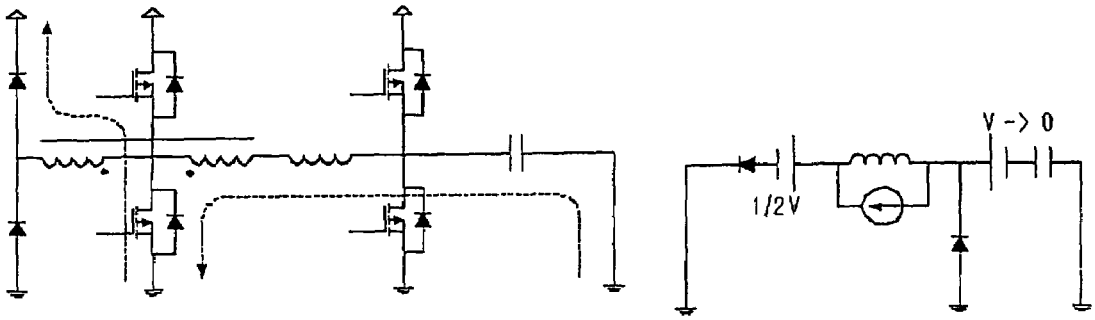
Figure 25F:
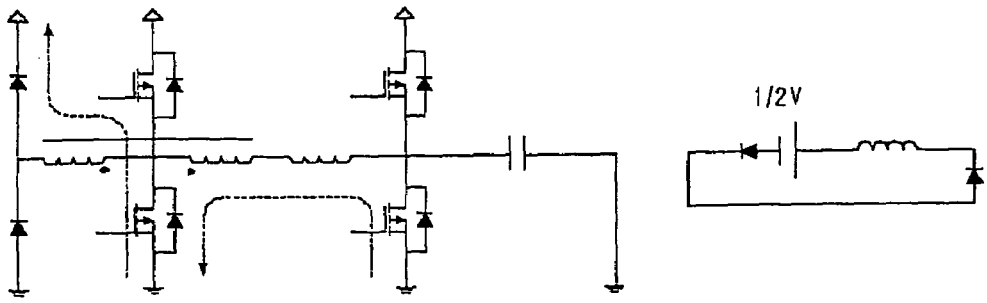

The current injection driving is characterized in that a drive switch SW4 is first turned on to boost the current of the resonant inductor L before resonance by the resonant inductor L and the load capacitance C starts to charge the load capacitance C, as shown in FIG. 25*a*. Similar to this, in FIG. 25*d*, a drive switch SW3 is turned on to boost the current of the resonant inductor L before resonance starts to discharge the load capacitance C.

Figure 26A:
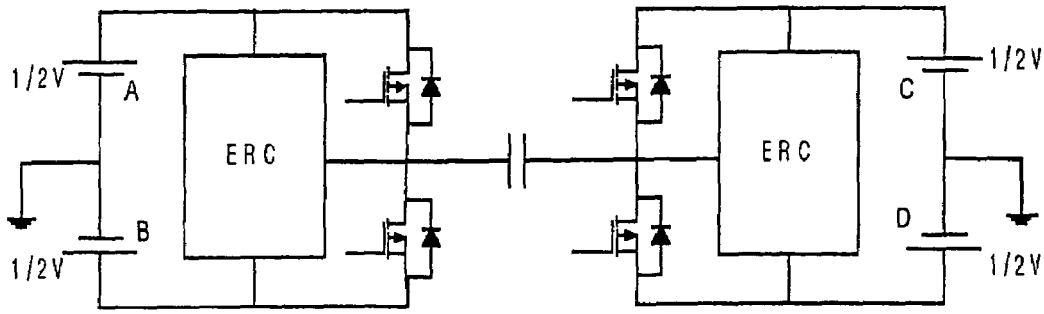
FIGS. 26*a* and 26*b* are circuit diagrams showing examples in which the energy recovery driving circuit of the present invention is applied to various driving circuits.
Figure 26B:
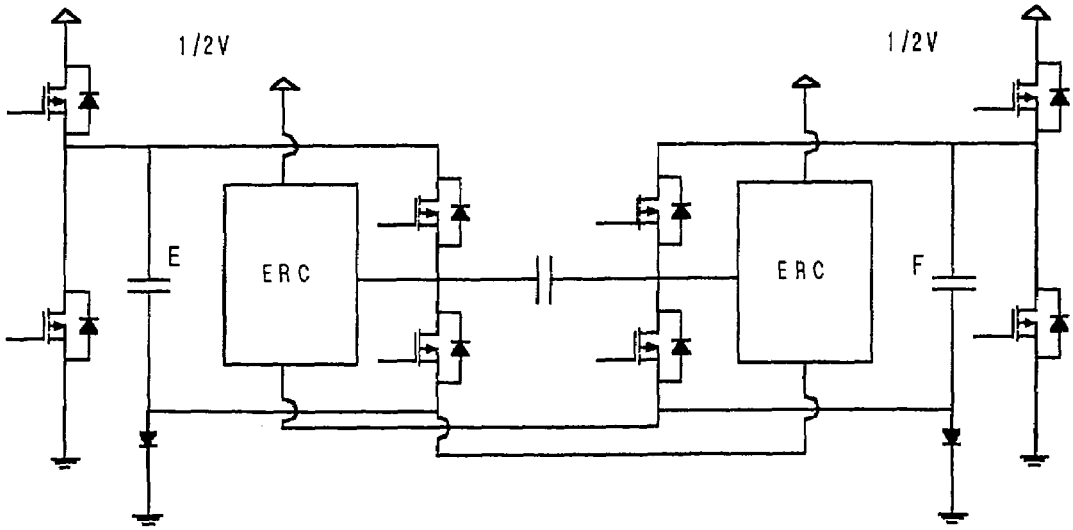

Applicability to Various Driving Circuits:

FIGS. 26*a* and 26*b* illustrate examples in which the energy recovery driving circuit of the present invention is applied to various driving circuits. The proposed Energy Recovery Circuit (ERC) using the regenerative transformer can be applied to various capacitive load driving circuits. FIGS. 26*a* and 26*b* illustrate these examples.

As shown in FIG. 26*a*, a driving circuit having two voltage sources (A and B of FIG. 26*a*) including ½ of the input voltage (V/2) and −½ of the input voltage (−V/2), as well as a driving circuit having an input voltage V and a ground voltage 0, can be implemented to perform the same operation for the capacitive load.

Further, as shown in FIG. 26*b*, by using charge pump capacitors E and F, −½ of the input voltage (−V/2) can be implemented only using ½ of the input voltage (V/2). Therefore, the energy recovery circuit ERC using the regenerative transformer proposed in the present invention can be applied to these various driving circuits.

Although the preferred embodiments of the present invention have been disclosed in the detailed description of the present invention for illustrative purposes, those skilled in the art will appreciate that various modifications, additions and substitutions are possible, without departing from the scope and spirit of the invention.

Therefore, the scope of the present invention must not be limited to the above embodiments, and must be defined in the accompanying claims and the like.

INDUSTRIAL APPLICABILITY

As described above, the present invention provides an energy recovery driving circuit, which can provide a new driving circuit for effectively driving charging/discharging energy recovery of a panel capacitance and the discharging of the panel. Further, the energy recovery driving circuit of the present invention is advantageous in that it is stable, it reduces noises causing Electromagnetic Interference (EMI), and it simply controls a switch driving circuit. The driving circuit of the present invention is advantageous in that, since charging and/or discharging energy of the panel capacitance is directly recovered to an input voltage source, a capacitor bank for an external voltage source, used to perform series resonance, can be omitted, thus reducing the number of elements of a panel driving circuit and simplifying the panel driving circuit. The driving circuit of the present invention can be constructed such that rated currents of some elements are reduced, thereby reducing production costs of the energy recovery driving circuit. According to the present invention, a zero current switching of switches of the energy recovery driving circuit is possible to further increase the drive efficiency of the energy recovery driving circuit. Further, the present invention enables 100% zero voltage switching of inverter clamping switches supplying panel discharging energy to be performed, thus further increasing the drive efficiency. In the present invention, it is possible to implement optimal resonance design in which system loss is taken into consideration such that the turn ratio of a transformer is controlled to increase a voltage between both ends of a panel capacitance up to an input voltage. These advantages of the present invention can be obtained by applying the present invention to all AC driving circuits with capacitive loads. The application of the present invention is not limited to driving circuits for the plasma display panel, which are mainly described above.

The invention claimed is:

1. An energy recovery driving circuit for driving a load with a certain capacitance, comprising:

a resonant inductor coupled to the load for alternately allowing a charge current or a discharge current to be applied to the load to flow through the resonant inductor;

a primary coil of a transformer, coupled to the resonant inductor, the primary coil being coupled to both the resonant inductor and the load so as to alternately allow the charge current or the discharge current to flow through the primary coil when the charge current or the discharge current alternately flows through the load through the resonant inductor;

at least one secondary coil of the transformer, coupled to the primary coil; and an energy recovery unit for generating a current according to the predetermined number of turns of the secondary coil in the secondary coil to allow the current flowing through the secondary coil to be recovered to a supply voltage source.

2. The energy recovery driving circuit according to claim 1, wherein the energy recovery unit comprises:

first switching means coupled to a supply voltage for receiving a first switching signal to allow a resonance current used to charge the load to flow through the resonant inductor from the supply voltage; and second switching means coupled to ground for receiving a second switching signal to allow a resonance current used to discharge the load to flow through the resonant inductor from the load.

3. The energy recovery driving circuit according to claim 2, further comprising a sustain driving unit for supplying a sustain voltage to the load;

wherein the sustain driving unit comprises, third switching means coupled between the supply voltage and the load to supply the sustain voltage to the load by reception of a third switching signal after the load is charged by the resonance current used to charge the load, fourth switching means coupled between the ground and the load to apply a ground voltage to the load by reception of a fourth switching signal after the load is discharged by the resonance current used to discharge the load, a first body diode coupled in parallel with the third switching means to prevent a charged voltage of the load from increasing to be greater than the supply voltage when the load is charged, and a second body diode coupled in parallel with the fourth switching means to prevent a discharged voltage of the load from decreasing to be less than the ground voltage when the load is discharged, wherein the resonance current is recovered to a supply voltage source through the third body diode after the load is charged to be greater than or equal to the supply voltage, and the resonance current is recovered to the ground through the fourth body diode after the load is discharged to be less than or equal to the ground voltage.

4. The energy recovery driving circuit according to claim 3, wherein the fourth switching means is turned on by reception of a charge boosting signal to boost a current of the resonant inductor before a resonance current used to charge the load flows through the fourth switching means, and the third switching means is turned on by reception of a discharge boosting signal to boost the current of the resonant inductor before a resonance current used to discharge the load flows through the third switching means, thus enabling the energy recovery driving circuit to be driven in a current injection manner.

5. The energy recovery driving circuit according to claim 3, wherein:

the primary coil has a first end coupled to the resonant inductor and a second end coupled to both the first and second switching means, the first switching means is coupled between the supply voltage and the primary coil, and the second switching means is coupled between the primary coil and the ground;

the energy recovery unit further comprises a first diode for conducting a current in an opposite direction of the ground and a second diode for conducting a current in a direction of the supply voltage; and the secondary coil comprises, a first secondary coil coupled in series with the first diode between a common end of the primary coil and the resonant inductor and the ground, and coupled to the primary coil so as to allow a charge current to flow out from the ground when the charge current flows through the primary coil, and a second secondary coil coupled in series with the second diode between the supply voltage and the common end of the primary coil and the resonant inductor, and coupled to the primary coil so as to allow a discharge current to flow into the supply voltage source when the discharge current flows through the primary coil.

6. The energy recovery driving circuit according to claim 5, wherein the number of turns of the secondary coil is greater than or equal to that of the primary coil.

7. The energy recovery driving circuit according to claim 3, wherein:

the primary coil has a first end coupled to the resonant inductor and a second end coupled to both the first and second switching means, the first switching means is coupled between the supply voltage and the primary coil, and the second switching means is coupled between the primary coil and the ground;

the energy recovery unit further comprises a first diode for conducting a current in an opposite direction of the ground and a second diode for conducting a current in a direction of the supply voltage; and the secondary coil is coupled between a common end of the primary coil and the resonant inductor and a common end of the first and second diodes, and is coupled to the primary coil for allowing a charge current to flow out from the ground when the charge current flows through the primary coil and allowing a discharge current to flow into the supply voltage source when the discharge current flows through the primary coil.

8. The energy recovery driving circuit according to claim 7, wherein the number of turns of the secondary coil is greater than or equal to that of the primary coil.

9. The energy recovery driving circuit according to claim 3, wherein:

the primary coil has a first end coupled to the resonant inductor and a second end coupled to both the first and second switching means, the first switching means is coupled between the supply voltage and the primary coil, and the second switching means is coupled between the primary coil and the ground;

the energy recovery unit further comprises a first diode for conducting a current in an opposite direction of the ground voltage from the ground voltage and a second diode for conducting a current in a direction of the supply voltage; and the secondary coil comprises, a first secondary coil coupled in series with the first diode between the primary coil and the ground, and coupled to the primary coil so as to allow a charge current to flow out from the ground when the charge current flows through the primary coil, and a second secondary coil coupled in series with the second diode between the supply voltage and the primary coil, and the ground voltage and coupled to the primary coil so as to allow a discharge current to flow into the supply voltage source when the discharge current flows through the primary coil.

10. The energy recovery driving circuit according to claim 9, wherein the resonant inductor is a leakage inductance of the transformer.

11. The energy recovery driving circuit according to claim 9, wherein the number of turns of the secondary coil is greater than or equal to two times that of the primary coil.

12. The energy recovery driving circuit according to claim 3, wherein:

the primary coil has a first end coupled to the resonant inductor and a second end coupled to both the first and second switching means, the first switching means is coupled between the supply voltage and the primary coil, and the second switching means is coupled between the primary coil and the ground;

the energy recovery unit further comprises a first diode for conducting a current in an opposite direction of the ground and a second diode for conducting a current in a direction of the supply voltage; and the secondary coil is provided with a first end coupled to the primary coil and a second end coupled to a common end of the first and second diodes, and is coupled to the primary coil for allowing a charge current to flow out from the ground when the charge current flows through the primary coil and allowing a discharge current to flow into the supply voltage source when the discharge current flows through the primary coil.

13. The energy recovery driving circuit according to claim 12, wherein the resonant inductor is a leakage inductance of the transformer.

14. The energy recovery driving circuit according to claim 12, wherein the number of turns of the secondary coil is greater than or equal to two times that of the primary coil.

15. The energy recovery driving circuit according to claim 3, wherein:

the primary coil has a first end coupled to the resonant inductor and a second end coupled to the load, the first switching means is coupled between the supply voltage and the resonant inductor, and the second switching means is coupled between the resonant inductor and the ground;

the energy recovery unit further comprises a first diode for conducting a current in an opposite direction of the ground and a second diode for conducting a current in a direction of the supply voltage; and the secondary coil comprises, a first secondary coil coupled in series with the first diode between a common end of the primary coil and the load and the ground, and coupled to the primary coil so as to allow a charge current to flow out from the ground when the charge current flows through the primary coil, and a second secondary coil coupled in series with the second diode between the supply voltage and the common end of the primary coil and the load, and coupled to the primary coil so as to allow a discharge current to flow into the supply voltage source when the discharge current flows through the primary coil.

16. The energy recovery driving circuit according to claim 15, wherein the resonant inductor is a leakage inductance of the transformer.

17. The energy recovery driving circuit according to claim 15, wherein the number of turns of the secondary coil is greater than or equal to that of the primary coil.

18. The energy recovery driving circuit according to claim 3, wherein:

the primary coil is coupled between the resonant inductor and the load, the first switching means is coupled between the supply voltage and the resonant inductor, and the second switching means is coupled between the resonant inductor and the ground;

the energy recovery unit further comprises first and second diodes for conducting a current in a direction of the supply voltage source;

the secondary coil comprises;

a first secondary coil coupled in series with the first diode between the supply voltage and the ground and coupled to the primary coil so as to allow a charge current to flow through the supply voltage source when the charge current flows through the primary coil, and a second secondary coil coupled in series with the second diode between the supply voltage and the ground and coupled to the primary coil so as to allow a discharge current to flow into the supply voltage source when the discharge current flows through the primary coil.

19. The energy recovery driving circuit according to claim 18, wherein the resonant inductor is a leakage inductance of the transformer.

20. The energy recovery driving circuit according to claim 18, wherein the number of turns of the secondary coil is greater than or equal to two times that of the primary coil.

21. The energy recovery driving circuit according to claim 3, wherein:

the primary coil has a first end coupled to the resonant inductor and a second end coupled to the load, the first switching means is coupled between the supply voltage and the resonant inductor, and the second switching means is coupled between the resonant inductor and the ground;

the energy recovery unit further comprises a first diode for conducting a current in an opposite direction of the ground and a second diode for conducting a current in a direction of the supply voltage; and the secondary coil is coupled between a common end of the primary coil and the load and a common end of the first and second diodes, and is coupled to the primary coil for allowing a charge current to flow out from the ground when the charge current flows through the primary coil and allowing a discharge current to flow into the supply voltage source when the discharge current flows through the primary coil.

22. The energy recovery driving circuit according to claim 21, wherein the resonant inductor is a leakage inductance of the transformer.

23. The energy recovery driving circuit according to claim 21, wherein the number of turns of the secondary coil is greater than or equal to that of the primary coil.

24. An energy recovery driving circuit for driving a load with a certain capacitance, comprising:

a first resonant inductor coupled to the load for alternately allowing a charge current or a discharge current to be applied to the load to flow through the first resonant inductor;

a primary coil of a first transformer, coupled to the first resonant inductor, the first transformer primary coil being coupled to both the first resonant inductor and the load so as to alternately allow the charge current or the discharge current to flow through the first transformer primary coil when the charge current or the discharge current alternately flows through the load through the first resonant inductor;

at least one secondary coil of the first transformer, coupled to the first transformer primary coil;

a first energy recovery unit for generating a current according to the predetermined number of turns of the first transformer secondary coil in the first transformer secondary coil to allow the current flowing through the first transformer secondary coil to be recovered to a supply voltage source;

a second resonant inductor coupled to the load for alternately allowing a charge current or a discharge current to be applied to the load to flow through the second resonant inductor;

a primary coil of a second transformer, coupled to the second resonant inductor, the second transformer primary coil being coupled to the load through the second resonant inductor so as to alternately allow a charge current or a discharge current to flow through the second transformer primary coil when the charge current or the discharge current alternately flows through the load through the second resonant inductor;

at least one secondary coil of the second transformer, coupled to the second transformer primary coil; and a second energy recovery unit for generating a current according to the predetermined number of turns of the second transformer secondary coil in the second transformer secondary coil to allow the current flowing through the second transformer secondary coil to be recovered to the supply voltage source, wherein the first and second energy recovery units are symmetrically arranged at respective ends of the load.

25. The energy recovery driving circuit according to claim 14, wherein the first transformer having the first transformer primary coil and the first transformer secondary coil, and the second transformer having the second transformer primary coil and the second transformer secondary coil are integrated into a single transformer.

26. The energy recovery driving circuit according to claim 24, wherein each of the first and second energy recovery units comprises:

first switching means coupled to a supply voltage for receiving a first switching signal to allow a resonance current used to charge the load to flow through the resonant inductor from the supply voltage; and second switching means coupled to ground for receiving a second switching signal to allow a resonance current used to discharge the load to flow through the resonant inductor from the load.

27. The energy recovery driving circuit according to claim 26, wherein the first transformer having the first transformer primary coil and the first transformer secondary coil, and the second transformer having the second transformer primary coil and the second transformer secondary coil are integrated into a single transformer.

28. The energy recovery driving circuit according to claim 24, further comprising first and second sustain driving units for supplying a sustain voltage to the load;

wherein the first and second sustain driving units each comprises, third switching means coupled between the supply voltage and the load to supply the sustain voltage to the load by reception of a third switching signal after the load is charged by the resonance current used to charge the load, fourth switching means coupled between the ground and the load to apply a ground voltage to the load by reception of a fourth switching signal after the load is discharged by the resonance current used to discharge the load, a first body diode coupled in parallel with the third switching means to prevent a charged voltage of the load from increasing to be greater than the supply voltage when the load charged, and a second body diode coupled in parallel with the fourth switching means to prevent a discharged voltage of the load from decreasing to be less than the ground voltage when the load is discharged, wherein the resonance current is recovered to the supply voltage source through the third body diode after the load is charged to be greater than or equal to the supply voltage, the resonance current is recovered to the ground through the fourth body diode after the load is discharged to be less than or equal to the ground voltage, the fourth switching means of the second sustain driving unit is turned on during an operating mode in which the third switching means of the first sustain driving unit is turned on, and the third switching means of the second sustain driving unit is turned on during an operating mode in which the fourth switching means of the first sustain driving unit is turned on.

29. The energy recovery driving circuit according to claim 28, wherein the first transformer having the first transformer primary coil and the first transformer secondary coil, and the second transformer having the second transformer primary coil and the second transformer secondary coil are integrated into a single transformer.

* * * * *